US009065207B2

(12) United States Patent
Chapel et al.

(10) Patent No.: US 9,065,207 B2
(45) Date of Patent: Jun. 23, 2015

(54) LOCKING ELECTRICAL RECEPTACLE

(75) Inventors: Steve Chapel, Iliff, CO (US); William Pachoud, Boulder, CO (US)

(73) Assignee: ZONIT STRUCTURED SOLUTIONS, LLC, Boulder, CO (US)

( * ) Notice: Subject to any disclaimer, the term of this patent is extended or adjusted under 35 U.S.C. 154(b) by 160 days.

(21) Appl. No.: 13/088,234

(22) Filed: Apr. 15, 2011

(65) Prior Publication Data

US 2011/0312207 A1 Dec. 22, 2011

Related U.S. Application Data

(63) Continuation-in-part of application No. 12/568,444, filed on Sep. 28, 2009, now Pat. No. 8,152,554, which is a continuation-in-part of application No. 12/531,235, filed as application No. PCT/US2008/057149 on Mar. 14, 2008, now abandoned.

(60) Provisional application No. 61/324,557, filed on Apr. 15, 2010, provisional application No. 61/346,316, filed on May 19, 2010, provisional application No. 61/353,496, filed on Jun. 10, 2010.

(51) Int. Cl.

| | |
|---|---|
| ***H01R 4/50*** | (2006.01) |
| ***H01R 13/627*** | (2006.01) |
| ***H01R 13/639*** | (2006.01) |
| ***H01R 43/26*** | (2006.01) |
| *H01R 13/20* | (2006.01) |

(52) U.S. Cl.

CPC ..... *H01R 13/627* (2013.01); *H01R 13/20* (2013.01); *H01R 13/639* (2013.01); *H01R 43/26* (2013.01)

(58) Field of Classification Search

USPC ..... 439/346, 102, 258, 268

See application file for complete search history.

(56) References Cited

U.S. PATENT DOCUMENTS

| | | | | | |
|---|---|---|---|---|---|
| 1,376,401 | A | * | 5/1921 | Claytor | 439/839 |
| 1,404,098 | A | * | 1/1922 | Dennis | 439/28 |
| 1,939,259 | A | * | 12/1933 | Good | 200/51.05 |
| 2,075,632 | A | * | 3/1937 | Zuckerman | 439/222 |
| 2,198,504 | A | * | 4/1940 | Pool | 439/346 |
| 2,222,715 | A | * | 11/1940 | Kuhlman | 439/269.2 |
| 2,274,798 | A | * | 3/1942 | Kostal | 439/269.2 |
| 2,307,592 | A | * | 1/1943 | Kuhlman | 439/269.2 |
| 2,393,083 | A | * | 1/1946 | Wizegarver | 439/268 |
| 2,493,457 | A | * | 1/1950 | Kenure et al. | 439/269.2 |
| 2,732,531 | A | * | 1/1956 | Janewicz | 439/346 |
| 2,923,909 | A | * | 2/1960 | Modrey | 439/593 |
| 2,997,681 | A | * | 8/1961 | Klassen | 439/268 |
| 3,155,448 | A | * | 11/1964 | Korsgren, Jr. | 439/271 |

(Continued)

*Primary Examiner* — Neil Abrams

(74) *Attorney, Agent, or Firm* — Marsh Fischmann & Breyfogle LLP; Kent A. Fischmann

(57) ABSTRACT

Locking electrical receptacles and methods for selectively securing an electrical connection. One or more prongs of an electrical plug may be engaged by a clamping element disposable between a clamping configuration and a release configuration. A release mechanism accessible to a user when the electrical connection between a receptacle and plug is established may dispose the clamping mechanism in the release configuration. The clamping element may include a first and second portion that undergo relative movement to impart a shear force on the one or more prongs retained by the clamping mechanism. Furthermore, a strain relief mechanism may be provided to release the plug at a predetermined level of force by moving the clamping element deflectable portion (188) to a release configuration.

13 Claims, 30 Drawing Sheets

(56) References Cited

U.S. PATENT DOCUMENTS

| | | | | | |
|---|---|---|---|---|---|
| 3,171,183 | A | * | 3/1965 | Johnston | 24/635 |
| 3,281,754 | A | * | 10/1966 | Cadwallader | 439/269.2 |
| 3,300,752 | A | * | 1/1967 | Mayer et al. | 439/837 |
| 3,319,215 | A | * | 5/1967 | Moore | 439/437 |
| 3,325,775 | A | * | 6/1967 | Zak | 439/848 |
| 3,543,218 | A | * | 11/1970 | Archer | 439/346 |
| 3,569,903 | A | * | 3/1971 | Brishka | 439/352 |
| 3,668,610 | A | * | 6/1972 | Flanagan | 439/268 |
| 3,745,514 | A | * | 7/1973 | Brishka | 439/848 |
| 3,796,987 | A | * | 3/1974 | Kinkaid et al. | 439/748 |
| 3,976,348 | A | * | 8/1976 | Simmons | 439/268 |
| 4,220,388 | A | * | 9/1980 | Dechelette | 439/268 |
| 4,345,122 | A | * | 8/1982 | Janniello | 200/50.29 |
| 4,374,607 | A | * | 2/1983 | Bright et al. | 439/825 |
| 4,407,558 | A | * | 10/1983 | Thrift | 439/268 |
| 4,415,221 | A | * | 11/1983 | Inoue et al. | 439/849 |
| 4,566,747 | A | * | 1/1986 | Peers | 439/270 |
| 4,586,770 | A | | 5/1986 | Poulin | |
| 4,700,997 | A | * | 10/1987 | Strand | 439/372 |
| 4,713,020 | A | * | 12/1987 | Awano et al. | 439/267 |
| 4,753,612 | A | * | 6/1988 | Betsui | 439/596 |
| 4,787,866 | A | * | 11/1988 | Morningstar et al. | 439/268 |
| 4,822,290 | A | | 4/1989 | Cauley | |
| 4,867,697 | A | * | 9/1989 | Borges | 439/265 |
| 4,971,571 | A | * | 11/1990 | Puerner | 439/346 |
| 4,973,271 | A | * | 11/1990 | Ishizuka et al. | 439/839 |
| 4,976,635 | A | * | 12/1990 | Gottardo et al. | 439/849 |
| 4,978,315 | A | * | 12/1990 | Edgley et al. | 439/441 |
| 5,011,439 | A | * | 4/1991 | Pawlicki | 439/847 |
| 5,044,972 | A | * | 9/1991 | Ikeda | 439/268 |
| 5,083,936 | A | * | 1/1992 | Yang | 439/441 |
| 5,083,947 | A | * | 1/1992 | Dominique et al. | 439/725 |
| 5,174,293 | A | * | 12/1992 | Hagiwara | 600/300 |
| 5,352,132 | A | * | 10/1994 | O'Keefe et al. | 439/346 |
| 5,393,239 | A | * | 2/1995 | Ursich | 439/180 |
| 5,735,716 | A | * | 4/1998 | Bilezikjian | 439/843 |
| 6,039,614 | A | * | 3/2000 | Ramari | 439/843 |
| 6,629,865 | B2 | * | 10/2003 | Bungo | 439/852 |
| 6,835,085 | B2 | * | 12/2004 | Sone et al. | 439/352 |
| 6,981,888 | B2 | * | 1/2006 | O'Keefe et al. | 439/369 |
| 7,104,818 | B1 | * | 9/2006 | Chang | 439/140 |
| 7,232,349 | B1 | * | 6/2007 | Chen | 439/810 |
| 7,351,088 | B1 | * | 4/2008 | Qu | 439/352 |
| 7,361,045 | B1 | | 4/2008 | Vinciguerra | |
| 7,597,577 | B1 | * | 10/2009 | Huang et al. | 439/354 |
| 8,083,532 | B1 | * | 12/2011 | Nicholson et al. | 439/180 |
| 8,152,554 | B2 | * | 4/2012 | Chapel et al. | 439/346 |
| 8,328,586 | B2 | * | 12/2012 | Bies et al. | 439/725 |
| 8,342,891 | B2 | * | 1/2013 | Fukushi | 439/752 |
| 8,668,512 | B2 | * | 3/2014 | Chang | 439/304 |
| 8,714,995 | B2 | * | 5/2014 | Chang | 439/345 |
| 2003/0207606 | A1 | * | 11/2003 | Ho | 439/346 |
| 2006/0032733 | A1 | | 2/2006 | Ling | |
| 2012/0115348 | A1 | * | 5/2012 | Reaves et al. | 439/357 |

* cited by examiner

LOCKING ELECTRICAL RECEPTACLE

RELATED APPLICATIONS

This application claims priority to U.S. Provisional Application Ser. No. 61/324,557, filed Apr. 15, 2010, entitled "LOCKING ELECTRICAL RECEPTACLE SECURE LOCKING MECHANISM;" U.S. Provisional Application Ser. No. 61/346,316, filed May 19, 2010, entitled "LOCKING ELECTRICAL RECEPTACLE ALTERNATE OPERATING MECHANISMS;" U.S. Provisional Application Ser. No. 61/353,496, filed Jun. 10, 2010, entitled "LOCKING ELECTRICAL RECEPTACLE PROGRAMMABLE RELEASE TENSION MECHANISMS." The entirety of each of the foregoing applications is hereby incorporated by reference. This application claims priority to U.S. application Ser. No. 12/568,444, filed Sep. 28, 2009, entitled "LOCKING ELECTRICAL RECEPTACLE," which is a continuation-in-part of U.S. application Ser. No. 12/531,235, filed Sep. 14, 2009, entitled "LOCKING ELECTRICAL RECEPTACLE," which is the U.S. National Stage of PCT Application US2008/57149, filed Mar. 14, 2008, entitled "LOCKING ELECTRICAL RECEPTACLE," the entirety of each of the foregoing applications is hereby incorporated by reference.

BACKGROUND

A wide variety of electrical connectors are known to provide electrical contact between power supplies and electrical devices. Connectors typically include prong type terminals (generally referred to as plugs) and female connectors designed for receiving the prong type terminals (generally referred to as receptacles and often described as electrical outlets, or simply outlets). The most common types of outlets include a pair of terminal contacts that receive the prongs of a plug that are coupled to "hot" and "neutral" conductors. Further, outlets may include a terminal contact that receives a ground prong of a plug. A variety of standards have been developed for outlets in various regions of the world.

Regardless of the standard at issue, the design of the aforementioned most common plug and receptacle system generally incorporates a friction only means of securing the two in the mated position. The frictional coefficient varies depending on a variety of conditions, including, but not limited to, manufacturing processes, foreign materials acting as lubricants, and wear and distortion of the assemblies. This characteristic results in a non-secure means of interconnecting AC or DC power between two devices. It is arguably the weakest link in the power delivery system to electrical or electronic devices utilizing the system. However, it has been adopted worldwide as a standard, and is used primarily due to low cost of manufacture, ease of quality control during manufacture, and efficient use of space for the power delivery it is intended to perform.

The primary limitation of this connection technique is simply the friction fit component. In applications where the continuity of power may be critical, such as data or medical applications, a technique to secure the mated connection may be desirable to improve the reliability. This may especially be true in mechanically active locations, such as where vibration is present, or where external activity may cause the cords attached to the plugs and receptacles to be mechanically deflected or strained in any manner.

It is against this background that the locking electrical receptacle of the present invention has been developed.

SUMMARY

The present invention is directed to securing an electrical connection. In some cases, a plug and socket electrical connection may be the least secure link in the power delivery system. Conventionally, these connections are secured only by means of a friction fit. A number of factors may affect the security of this connection. The present invention provides a variety of locking mechanisms whereby the withdrawal forces that would otherwise tend to pull a connection apart served to actuate a clamping mechanism thereby securing the mated pair. Furthermore, a release mechanism for each locking mechanism may be provided that serves to dispose the clamping mechanism in a release position so as to selectively release the plug and socket electrical connection. Furthermore, a release mechanism may be provided such that a predetermined force acting on the receptacle releases the clamping mechanism without any user actuation being required. Moreover, the invention is a simple construction and highly reliable in operation.

A first aspect of the present invention includes an apparatus for use in securing an electrical connection. The electrical connection is formed by a mating structure including prongs of a male assembly and receptacles of a female assembly, and the electrical connection is broken by withdrawal of the prongs from the receptacles. The apparatus includes a housing, the housing having a front surface defining an interface area between the male assembly and female assembly. The apparatus also includes a clamping element disposed within the housing and moveable between a clamping configuration and a release configuration. The clamping element engages at least one of the prongs to hold the mating structure in a connected state in the clamping configuration. The apparatus also includes a release mechanism in operative communication with the clamping element to dispose the clamping element at least from the clamping configuration to the release configuration. The release mechanism may also include a user actuation element. At least a portion of the release mechanism extends from the clamping element in a direction corresponding to the insertion of the prongs into the receptacles.

A number of feature refinements and additional features are applicable to the first aspect. These feature refinements and additional features may be used individually or in any combination. As such, each of the following features that will be discussed may be, but are not required to be, used with any other feature or combination of features of the first aspect.

In one embodiment, a first end of the release mechanism may be operatively engaged (e.g., in contact with) with the clamping mechanism and a second end of the release mechanism extends away from the interface area. The user actuation element of the apparatus may be used to engage the release mechanism with the clamping mechanism. For example, the user actuation element may be retracted away from the interface area to move the clamping element from the clamping configuration to the release configuration. Alternatively, the user actuation element may be advanced toward the interface area to move the clamping element from the clamping configuration to the release configuration. For instance, the user actuation element may engage a first end portion of a crank disposed opposite of a second end portion such that the first end portion and the second end portion of the crank are separated by a pivot. Accordingly, advancement of the user actuation element results in retraction of the second end portion relative to the interface area. The second end may be in operative engagement with a shuttle in contact with the clamping element to dispose the clamping element in the release configuration.

In another embodiment, the user actuation element may be accessible from an exterior of the housing when the prongs are inserted into the receptacles. The user actuation element may comprise at least one of a pull knob, a pull collar, pull tab or a swash plate. For instance, the swash plate may engage the second end to advance the user actuation element toward the interface and/or retract the user actuation element away from the interface. The release mechanism may comprise a rod extending through at least a portion of the housing. As such, a threaded portion of the rod may be advanceable and/or retractable with respect to the interface area upon rotation of the threaded portion of the rod with respect to a corresponding threaded portion of the housing. Additionally, the threaded portion of the rod and the threaded portion of the housing may be operative to maintain the clamping element in the clamping configuration and/or the release configuration. The rod may comprise a tooled interface and/or a knurled knob adapted to impart the rotation of the threaded portion. Further still, the user actuation element may comprise a lever actuator acting on the release mechanism.

A second aspect includes an apparatus for use in securing an electrical connection. The electrical connection is formed by a mating surface including prongs of a male assembly and receptacles of a female assembly, and the electrical connection is broken by withdrawal of the prongs from the receptacles. The apparatus comprises a housing having a front surface defining an interface area between the male assembly and female assembly. Additionally, the housing includes a clamping element disposed within the housing that is moveable between a clamping configuration and a release configuration. The clamping element holds the mating structure in a connected state in the clamping configuration. The apparatus further includes a release mechanism operatively engaged with the clamping element that is responsive to a force acting to withdrawal the prong from the receptacle exceeding a predetermined value to dispose the clamping element to the release configuration.

A number of feature refinements and additional features are applicable to the second aspect. These feature refinements and additional features may be used individually or in combination. As such, each of the following features that will be discussed may be, but are not required to be, used with any other feature or combination of features of the second aspect.

In one embodiment, the release mechanism may comprise a first portion engaged with the clamping element and a second portion disposed for relative movement with respect to the first portion when the clamping element is disposed in the clamping configuration. An elastic member may be disposed between the first and second portions. The elastic member may exhibit an effective spring rate value. The effective spring rate value may at least partially determine the predetermined value of the force. The first portion may be fixed to the prong by way of the clamping element when the clamping element is in the clamping configuration when the force is less than the predetermined value. The second portion may operatively engage (e.g., via a telescopic outer grip, pull rod, pull arm, or the like) the clamping element to dispose the clamping element in the release configuration when the force is greater than the predetermined value. The relative movement may comprise axial movement.

In one embodiment, the second portion operatively engages the clamping element by way of a pull rod disposed between the second portion and the clamping element. The pull rod may extend away from the interface beyond the housing and is accessible by a user to dispose the clamping element in the release configuration absent the application of a force acting to withdrawal the prong from the receptacle.

A third aspect of the present invention includes an apparatus for use in securing an electrical connection. The electrical connection is formed by a mating surface including prongs of a male assembly and receptacles of a female assembly, and the electrical connection is broken by withdrawal of the prongs from the receptacles. The apparatus includes a housing having a front surface defining an interface area between the male assembly and female assembly. The apparatus also includes a clamping element disposed within the housing and moveable between a clamping configuration and a release configuration. The clamping element holds the mating structure in a connected state in the clamping configuration. The clamping element includes a first portion and a second portion.

At least a portion of the first portion and the second portion of the clamping element are disposed for relative movement upon deflection of the clamping element into the release configuration. The relative movement between the first portion and the second portion imparts a sheer force between the first portion and the second portion such that the sheer force acts in a direction transverse to the force tending to withdraw the prongs.

A number of feature refinements and additional features are applicable to the third aspect. These feature refinements and additional features may be used individually or in any combination. As such, each of the following features that will be discussed may be, but are not required to be, used with any other feature or combination of features of the third aspect.

In one embodiment, the clamping element may be operative to exert a clamping force on at least one of the prongs. The clamping element may be operative to exert a clamping force on a ground prong maintained at ground potential. The clamping element may be urged into the clamping configuration responsive to withdrawing movement of the prongs such that the withdrawing movement is smaller than required to break the connection. The clamping element may include a contact surface for contacting one of the prongs in the clamping configuration. The withdrawing movement of the prongs may result in movement of the contact surface. Additionally, the clamping element may comprise at least four contact surfaces for contacting one of the prongs in the clamping configuration. The withdrawing movement of the prong may result in movement of the contact surface having a component transverse to the movement of the prong.

In another embodiment, the apparatus may also include a release element for moving the clamping element into the release configuration. The release element may be adapted for operation by a user so as to break the connection when desired.

The apparatus may be integrated into a standard receptacle. Furthermore, the apparatus may be integrated into a standard cord cap receptacle.

A fourth aspect of the present invention includes a method of use of a locking electrical receptacle. The method includes inserting a prong into the locking electrical receptacle. The prong is retained in an inserted position by a clamping element that is responsive to withdrawal of the prong to clampingly engage the prong. The method further involves moving a release mechanism to displace the clamping element from the clamping configuration to a release configuration. At least a portion of the release mechanism extends in a direction corresponding to the insertion of the prong. The method further comprises withdrawing the prong from the locking electrical receptacle when the clamping element is in the release position.

A number of feature refinements and additional features are applicable to the fourth embodiment. These feature refinements and additional features may be used individually or in any combination. As such, each of the following features that will be discussed may be, but are not required to be, used with any other feature or combination of features of the fourth aspect.

In one embodiment, the inserting may include establishing electrical contact between the prong and the locking electrical receptacle. The clamping element may be urged into a clamping configuration by the withdrawal of the prong. The release mechanism may also comprise a user actuation element that is accessible from an exterior of a housing of the locking electrical receptacle when the prong is inserted into the receptacle. In another embodiment, the moving may comprise advancing at least a portion of the release mechanism relative to an interface between the prong and the locking electrical receptacle and/or retracting at least a portion of the release mechanism from the interface.

In another embodiment, the moving may comprise rotating the release mechanism comprising a threaded portion to advance and/or retract the release mechanism.

A fifth aspect of the present invention includes a method of use of a locking electrical receptacle. The method includes first applying a withdrawal force to at least one of the locking electrical receptacle or a prong inserted in mating engagement with the locking electrical receptacle that is less than a predetermined force value. The method further includes retaining the prong in mating engagement. The retaining includes disposing a clamping element in a clamping configuration with respect to the prong. The method further includes second applying a withdrawal force to at least one of the locking electrical receptacle or a prong inserted into the locking electrical receptacle that is greater than a predetermined force value. The method further includes releasing, in response to the second applying, the prong from mating engagement. The releasing includes disposing the clamping element in a release configuration with respect to the prong.

A number of feature refinements and additional features are applicable to the third aspect. These feature refinements and additional features may be used individually or in any combination. As such, each of the following features that will be discussed may be, but are not required to be, used with any feature or combination of features of the fifth embodiment.

In one embodiment, the releasing may further comprise overcoming a force applied to a first portion and a second portion of the locking electrical receptacle by an elastic member. Additionally, the method may include displacing a first portion of the locking electrical receptacle with respect to a second portion of the locking electrical receptacle. The first portion may be clampingly engaged with the prong. Furthermore, the method may include engaging the clamping element in response to the displacing to dispose the clamping element in the release configuration.

In another embodiment, the second portion may comprise a rigid member extending from the second portion to the clamping member. The rigid member may be displaceable along with the displacement of the second portion relative to the first portion.

A sixth aspect of the present invention includes a method of use of a locking electrical receptacle. The method involves applying a withdrawal force to the locking electrical receptacle and/or a prong inserted into the locking electrical receptacle and deflecting a spring prong retainer into a clamping configuration. The spring prong retainer has at least a first portion and a second portion, and the first portion and the second portion undergo relative movement. The method further includes clamping the prong with the spring prong retainer in response to the deflecting. The relative movement between the first portion and the second portion impart a clamping force to the prong.

A number of feature refinements and additional features are applicable to the sixth aspect. These feature refinements and additional features may be used alone or in any combination. As such, each of the features discussed below may be, but are not required to be, used with any feature or combination of features of the sixth aspect.

In one embodiment, the first portion may comprise a first aperture and the second portion may comprise a second aperture. When in a release configuration, the first aperture may be aligned with the second aperture to allow the prong to pass through the first and second aperture. The deflection operation may result in the first aperture becoming at least partially offset with respect to the second aperture. The first portion may deflect about a first pivot and the second portion may deflect about a second pivot. The first pivot and the second pivot may be spaced apart.

DETAILED DESCRIPTION

Figures 1A, 1B, 1C:
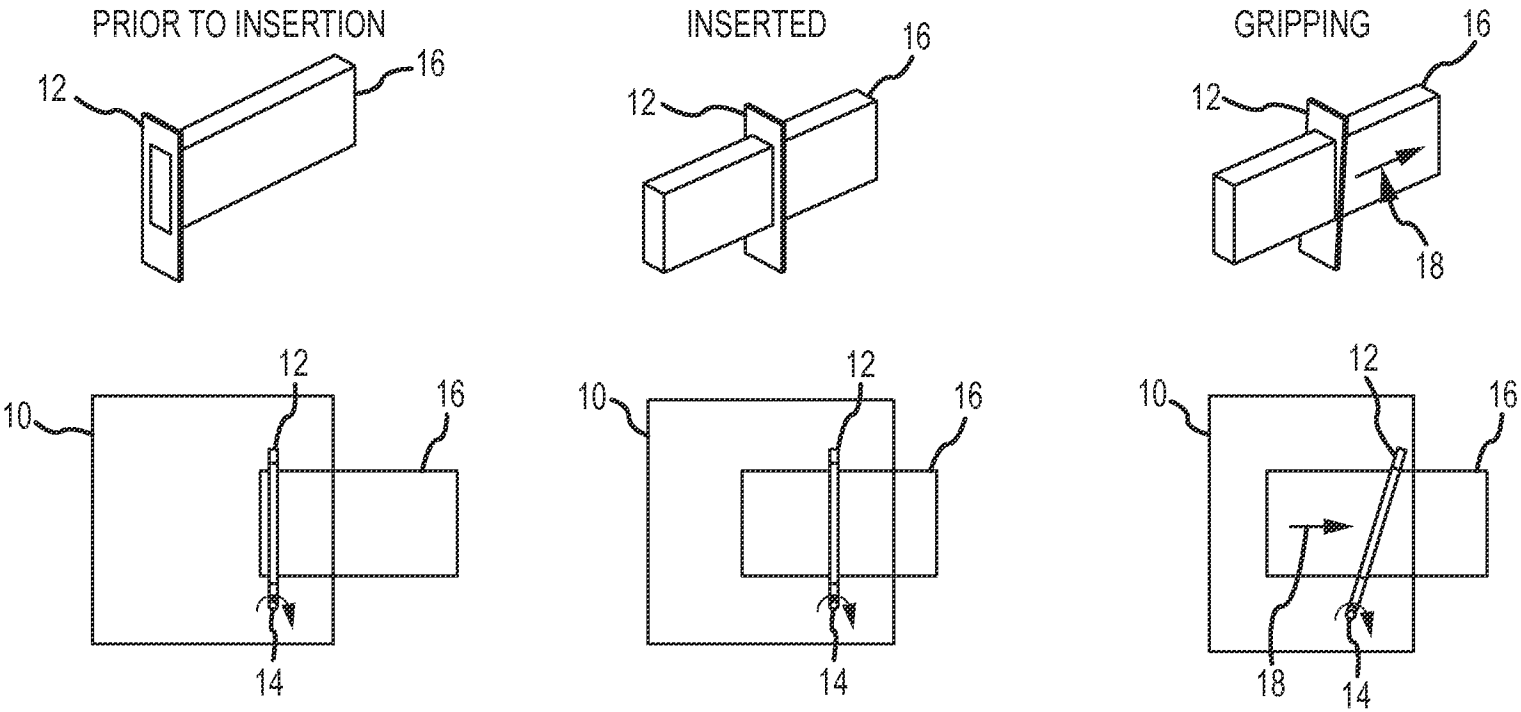
FIGS. 1A-1C illustrate the operation of an embodiment of a clamping mechanism.

While the invention is susceptible to various modifications and alternative forms, specific embodiments thereof have been shown by way of example in the drawings and are described in detail herein. It should be understood, however, that it is not intended to limit the invention to the particular form disclosed, but rather, the invention is to cover all modifications, equivalents, and alternatives falling within the scope and spirit of the invention as defined by the claims.

The following description is generally directed to locking electrical receptacles that facilitate locking retention of an electrical plug in a receptacle. Furthermore, a number of embodiments of release mechanisms are also described herein for selectively releasing a plug from a receptacle. Various embodiments of release mechanisms are described that may be included in a locking electrical receptacle to selectively release a plug from the receptacle. For instance, a strain relief mechanism may be provided such that force applied to a connected and locked electrical receptacle above a given threshold causes the electrical receptacle to release a plug to which it is connected. Accordingly, damage to the plug, cord, and/or receptacle resulting from high strains applied to a connected plug and receptacle may be avoided. Additionally, a number of embodiments are disclosed herein in which a release mechanism is provided such that a user can selectively release the plug from the receptacle. Such release mechanisms may be accessible to the user when the electrical connection is in a connected state. Furthermore, these release mechanisms may be used in conjunction with or separate from the strain release mechanisms as will be described herein.

Turning to FIGS. 1A-1C, the operation of an embodiment of a clamping mechanism 12 for securing a mated electrical connection that may be included in a locking receptacle 10 is illustrated. In each of the FIGS. 1A-1C, the bottom portion of the figures represents a side view of a prong 16 and a clamping mechanism 12, while the top portion represents a perspective view of the prong 16 and clamping mechanism 12. Referring first to FIG. 1A, the prong 16 of a plug is shown prior to insertion into a receptacle 10. The prong 16 may be a ground prong of a standard plug (e.g., an IEC 320 plug, a NEMA 5-15 plug, or the like) or may be various other sizes and/or shapes or other prongs. Further, the receptacle 10 may be the ground receptacle or other receptacle(s), of a standard outlet (e.g., a NEMA standard cord cap, an IEC 320 cord cap, or the like) that is operative to receive a standard plug. The receptacle 10 also includes that clamping mechanism 12 is coupled to a pivot 14. The clamping mechanism 12 includes an aperture that is sized to be slightly larger than the prong 16, such that the prong 16 may only pass through the aperture when the length of the clamping mechanism is substantially perpendicular to the length of the prong 16. That is, the design of the clamping mechanism 12 is such that a simple slide on and capture technique is utilized.

FIG. 1B illustrates the prong 16 when inserted into the receptacle 10. As shown, the prong 16 passes through the aperture in the clamping mechanism 12 and into the receptacle 10, such that the corresponding plug and outlet are in a mated position. As such, electrical communication is established between the prong 16 and the receptacle 10. The clamping mechanism 12 may further include a stop (not shown) to prevent the clamping mechanism 12 from pivoting during the insertion of the prong 16 (e.g., in a counter clockwise direction as shown in FIG. 1B). In this regard, during insertion of the prong 16, the length of the clamping mechanism 12 will remain substantially perpendicular to the length of the prong 16, which permits the passage of the prong through the aperture of the clamping mechanism 12.

FIG. 1C illustrates the gripping function of the clamping mechanism 12 in reaction to a withdrawal force 18 on the prong 16 that tends to withdrawal the prong 16 from the receptacle 10. In reaction to a withdrawal of the prong 16, the clamping mechanism 12 angularly deflects (i.e., rotates) about the spring pivot 14, causing the aperture in the clamping mechanism 12 to grip the prong 16. Thus, the very withdrawal force 18 that tends to withdraw the prong 16 from the receptacle 10 acts to actuate the clamping mechanism 12 to engage the prong 16, thereby preventing the withdrawal of the prong 16, and maintaining the electrical connection of the mated assembly. The clamping mechanism 12 may be constructed of any suitable material including, for example, a high strength dielectric with an imbedded metallic gripping tooth. An all-metallic clamping mechanism may also be used (e.g., if the prong 16 is a ground prong maintained at ground potential). For other prongs, modifications may be required to obtain approval by underwriting bodies.

Figure 2A:
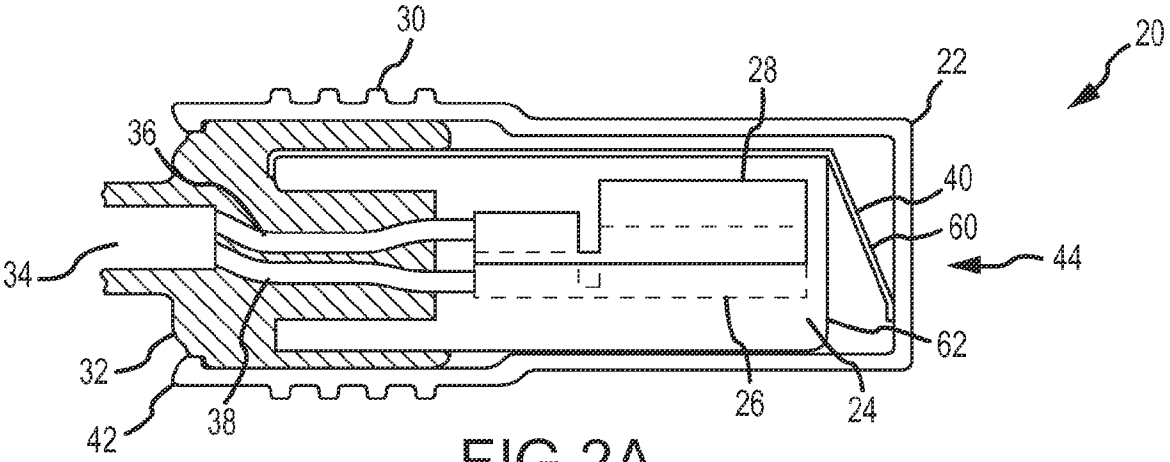
FIGS. 2A-2B illustrate an embodiment of a locking electrical receptacle.
Figure 2B:
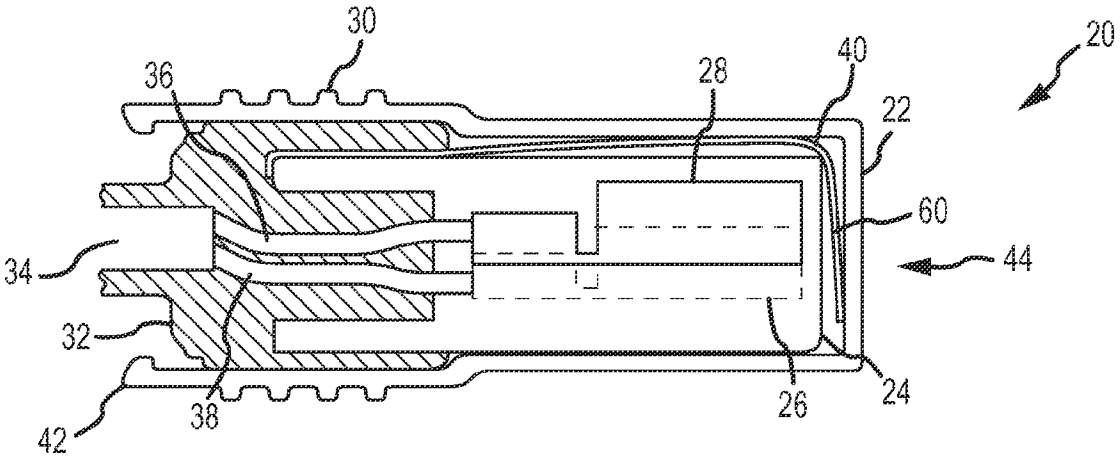

FIGS. 2A-2B illustrate a cross section of one embodiment of a locking electrical receptacle 20. The receptacle 20 may be an IEC type 320 cord cap receptacle that includes a locking mechanism as will be described below. The receptacle 20 includes an inner contact carrier module 24 that houses contact sockets 26 and 28 (a third socket for the three prong receptacle 20 can not be seen in the Figures). In electrical communication with the contact sockets 26 and 28 are wires 36 and 38 that extend out of the receptacle 20 though a cord 34. The carrier module 24 may be attached to a cord strain relief portion 32 that functions to prevent the cord 34 from separating from the carrier module 24 or otherwise resulting in damage to the assembly when a force is applied to the cord 34. The cord strain relief portion 32 may be an over-molded polymer or the like. A spring prong retainer 40 is disposed adjacent to a surface of the contact carrier module 24, and extends across a prong-receiving portion 44 of the receptacle 20.

One end of the spring prong retainer 40 is bent around the end of the inner contact carrier module 24, which secures it in the assembly (e.g., underneath the cord strain relief portion 32). Alternatively, the spring prong retainer 40 may be secured to the inner contact carrier module 24 by a screw or other fastener, and/or embedded in the contact carrier module 24. A section of the spring prong retainer 40 that is embedded in the module 24 or alternatively secured in the cord strain relief portion 32 may be configured (e.g., by punching a hole in the embedded section and/or serrating the edges or otherwise shaping it) to enhance the anchoring strength in the embedded section. The other end of the spring prong retainer 40 may comprise a deflectable portion 60 that may be in contact with a telescopic lock release grip 22 adjacent to the prong-receiving portion 44. Similar to the clamping mechanism 12 shown in FIGS. 1A-1C, the deflectable portion 60 of the spring prong retainer 40 includes an aperture sized to permit the passage of a prong (e.g., a ground prong maintained at ground potential) of a plug into the socket 26 when the deflectable portion 60 is substantially perpendicular with respect to a prong (not shown). The aperture in the spring prong retainer 40 may be sized to be slightly larger than the prong of a standard plug such that the aperture may function in a similar manner as the clamping mechanism 12 for the locking receptacle 10 discussed above with regard to FIG. 1.

It can be appreciated that prongs with different cross-section shapes, for example round prongs, can use the types of retention mechanisms described herein, with a suitable modification of the aperture shape and geometry of the spring prong retainer 40. Such modifications may be specific to the various shapes of the cross section of various prong types. Such variations will function in substantially the same manner as embodiments of the spring prong retainers described herein.

The spring prong retainer 40 may further be shaped and constructed, as will be discussed in more detail below, to inhibit contact with other prongs and provide a desired release tension. Moreover, the retainer 40 may be retained within a recessed channel formed in the module 24 to further inhibit transiting or side-to-side displacement of the retainer 40. The operation of the clamping feature of the spring prong retainer 40 is discussed in detail below.

FIG. 2A illustrates the locking receptacle 20 in the locked position. As shown, the deflectable portion 60 of the spring prong retainer 40 disposed adjacent to the prong receiving portion 44 of the receptacle 20 is not in a substantially vertical position. That is, the deflectable portion 60 of the spring prong retainer 40 is disposed at an angle with respect to an end face 62 of the contact carrier module 24 and the prong receiving portion 44. The deflectable portion 60 may be biased into the position shown in FIG. 2A by an internal spring force of the spring prong retainer 40. Similar to the operation of the clamping mechanism 12 shown in FIGS. 1A-1C, the aperture of the spring prong retainer 40 may allow the prong of a plug to pass freely into the socket 26 when the prong is inserted as the deflectable portion 60 may deflect toward the substantially perpendicular position upon insertion of the plug therethrough. This is due to the unrestricted change of position of the deflectable portion 60 of the spring prong retainer 40 to the substantially vertical position (shown in FIG. 2B) as the prong of a plug acts upon it when being advanced into a mated configuration. That is, advancement of the prong through the aperture provided on the deflectable portion 60 may result in the deflectable portion 60 deflecting into the substantially vertical position against the biasing force acting on the deflectable portion 60 to allow the prong to pass through the aperture into mating engagement with the receptacle 26. The end face 62 of the contact carrier module 24 may limit the deflectable portion 60 to a substantially perpendicular arrangement with the prong when the prong is being inserted.

Figure 3A:
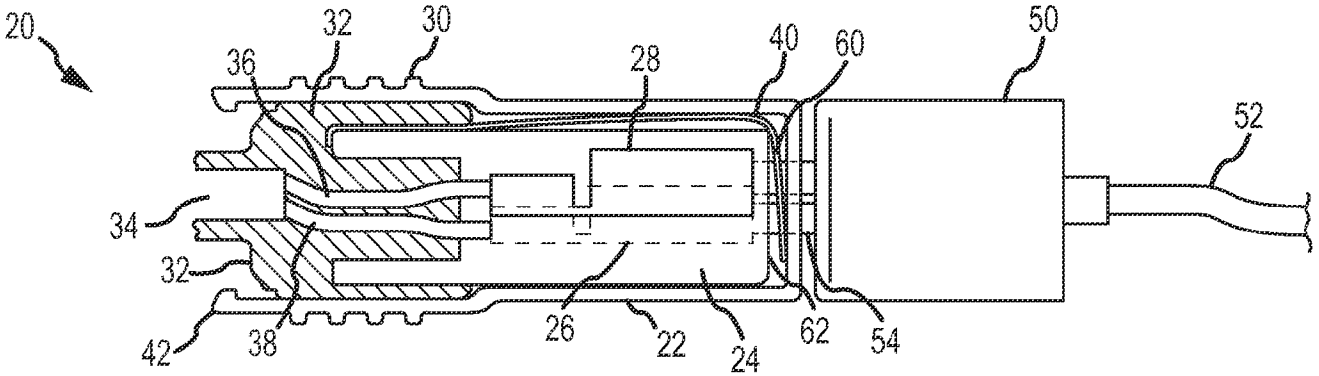
FIGS. 3A-3B illustrate an application for the locking electrical receptacle shown in FIGS. 2A-2B.
Figure 3B:
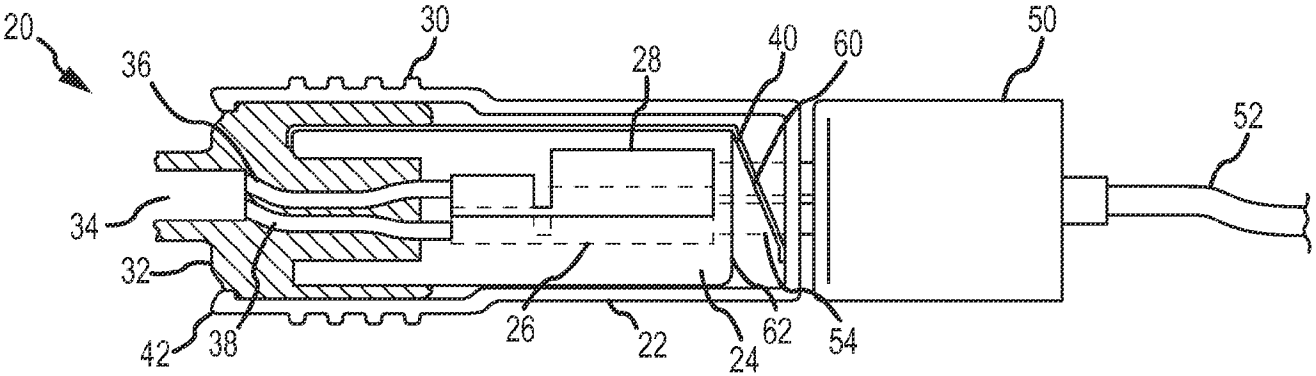

FIG. 2B illustrates the locking receptacle 20 when a force is applied to the cord 34 of the receptacle 20 in the opposite direction of the grip release handle 30. That is, the contact carrier module 24 may be advanced with respect to the lock release grip 22 or the lock release grip 22 may be retracted with respect to the contact carrier module 24 such that the deflectable portion 60 of the spring prong retainer 40 is urged against an adjacent interior wall of the lock release grip 22 such that the deflectable portion 60 of the spring prong retainer 40 is moved to a substantially perpendicular arrangement. This is the "release position" of the receptacle 20 and is shown without the mating prongs for clarity of operation. FIG. 3A illustrates the operation of the locking electrical receptacle 20 shown in FIGS. 2A-2B. When a prong 54 of a plug 50 first enters the receptacle 20 via an aperture in the lock release grip 22, it encounters the spring prong retainer 40, which is not in the perpendicular orientation at that time. Upon additional insertion, the prong 54 passes through the aperture on the deflectable portion 60 of the spring prong retainer 40 and the deflectable portion 60 is deflected into the perpendicular position against the end face 62 by the force applied to it by the prong 54 as it passes through the aperture. The prong 54 continues to pass through the aperture in the spring prong retainer 40 and into the contact socket 26, making the electrical connection between the prong 54 and receptacle 26. Upon release of the insertion force, and when no axial strain is applied to the mated plug 50 and receptacle 20, the spring prong retainer 40 is only partially displaced from the perpendicular orientation shown in FIG. 3A. It is noted that when so inserted there is little separation between the forward-most surface of the plug 50 and the end of the receptacle of receptacle 20 (i.e., the interface between the plug 50 and the receptacle 20) adjacent the plug 50 in this connected configuration, i.e., the prong extends to substantially the conventional extent into the receptacle 20. FIG. 3B illustrates in an exaggerated manner the condition of applying axial tension to the cord 34 of the receptacle 20.

FIG. 3A illustrates the operation of the locking electrical receptacle 20 shown in FIGS. 2A-2B. When a prong 54 of a plug 50 first enters the receptacle 20 via an aperture in the lock release grip 22, it encounters the spring prong retainer 40, which is not in the perpendicular orientation at that time. Upon additional insertion, the prong 54 passes through the aperture on the deflectable portion 60 of the spring prong retainer 40 and the deflectable portion 60 is deflected into the perpendicular position against the end face 62 by the force applied to it by the prong 54 as it passes through the aperture. The prong 54 continues to pass through the aperture in the spring prong retainer 40 and into the contact socket 26, making the electrical connection between the prong 54 and receptacle 26. Upon release of the insertion force, and when no axial strain is applied to the mated plug 50 and receptacle 20, the spring prong retainer 40 is only partially displaced from the perpendicular orientation shown in FIG. 3A. It is noted that when so inserted there is little separation between the forward-most surface of the plug 50 and the end of the receptacle of receptacle 20 (i.e., the interface between the plug 50 and the receptacle 20) adjacent the plug 50 in this connected configuration, i.e., the prong extends to substantially the conventional extent into the receptacle 20. FIG. 3B illustrates in an exaggerated manner the condition of applying axial tension to the cord 34 of the receptacle 20.

A slight retraction motion caused by any tension on the cord 34 acts on the deflectable portion 60 of the spring prong retainer 40 to deflect the deflectable portion 60 away from the substantially perpendicular position shown in FIG. 3A thereby increasing the angle of grip of the deflectable portion 60 and subsequent tightening of the offset angle of the deflectable portion 60 and prong 54. The receptacle 20 and the plug 50 are then fully locked in this condition. Further application of a withdrawal force tending to remove the plug 50 from contact with the receptacle 26 further deflects the deflectable portion 60 away from the perpendicular arrangement shown in FIG. 3A, which in turn leads to greater application of a clamping force on the prong 54 as the deflectable portion 60 deflects with the withdrawal force acting on the plug 50.

Upon application of axial compression between the release grip handle 30 and the plug 50, the lock receptacle grip 22 may move axially with respect to the contact carrier module 24 such that the deflectable portion 60 of the spring prong retainer 40 is contacted by an adjacent interior wall of the lock receptacle grip 22. As such, the position of the deflectable portion 60 of the spring prong retainer 40 is returned to the near-perpendicular position as illustrated in FIG. 3A, thereby releasing the spring prong retainer 40 from the prong 54. Upon release, the receptacle 20 is easily separated from the plug 50. Because the release grip handle 30 of the lock release grip 22 is mounted to slide in telescoping fashion with respect to the contact carrier module 24 and can be gripped for prong release from the top or sides, the spring prong retainer 40 can be easily released even in crowded or space limited environments such as in data centers.

Figure 4A:
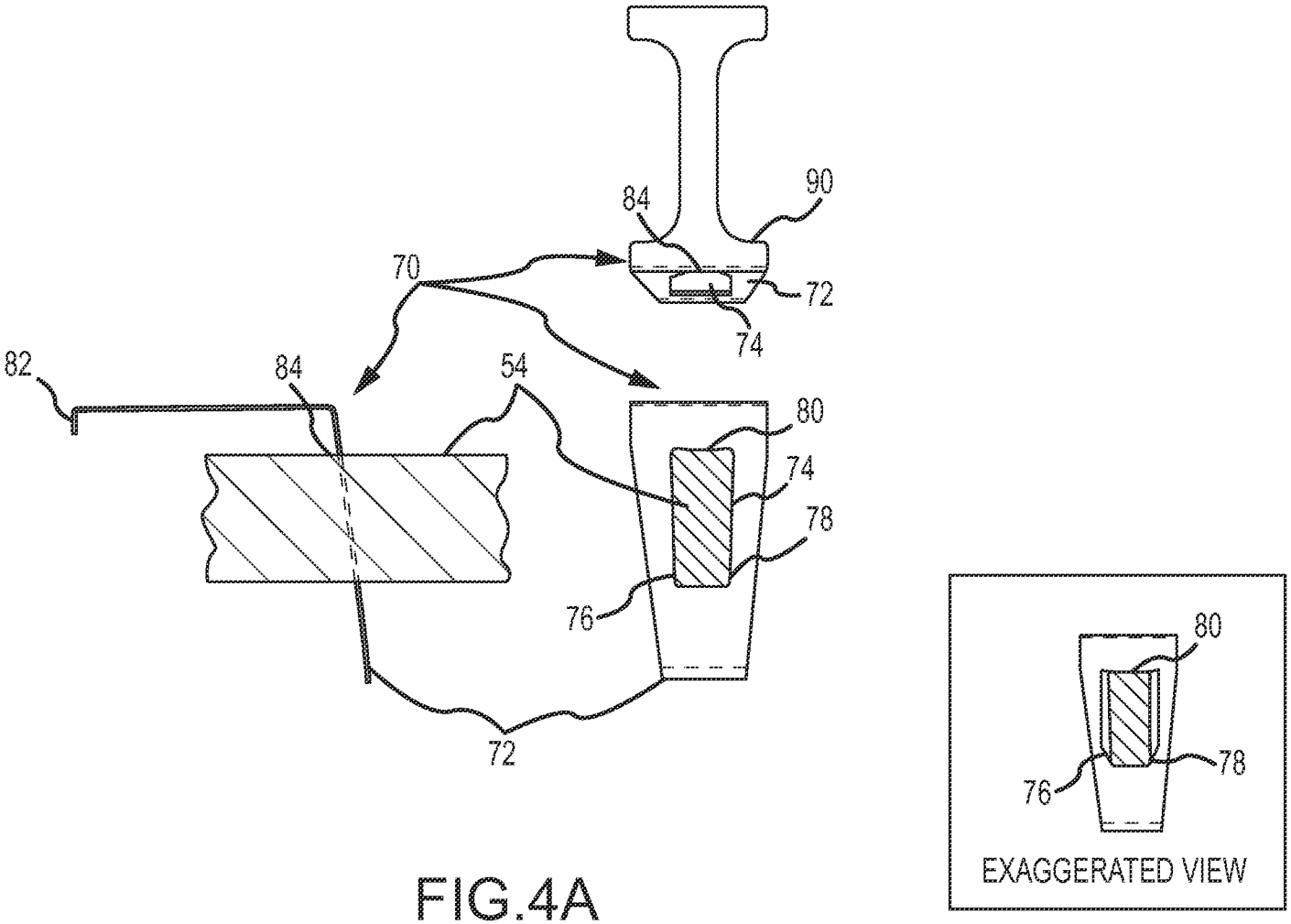
FIGS. 4A-4C illustrate an embodiment of spring prong retainer for use with a locking electrical receptacle.
Figure 4B:
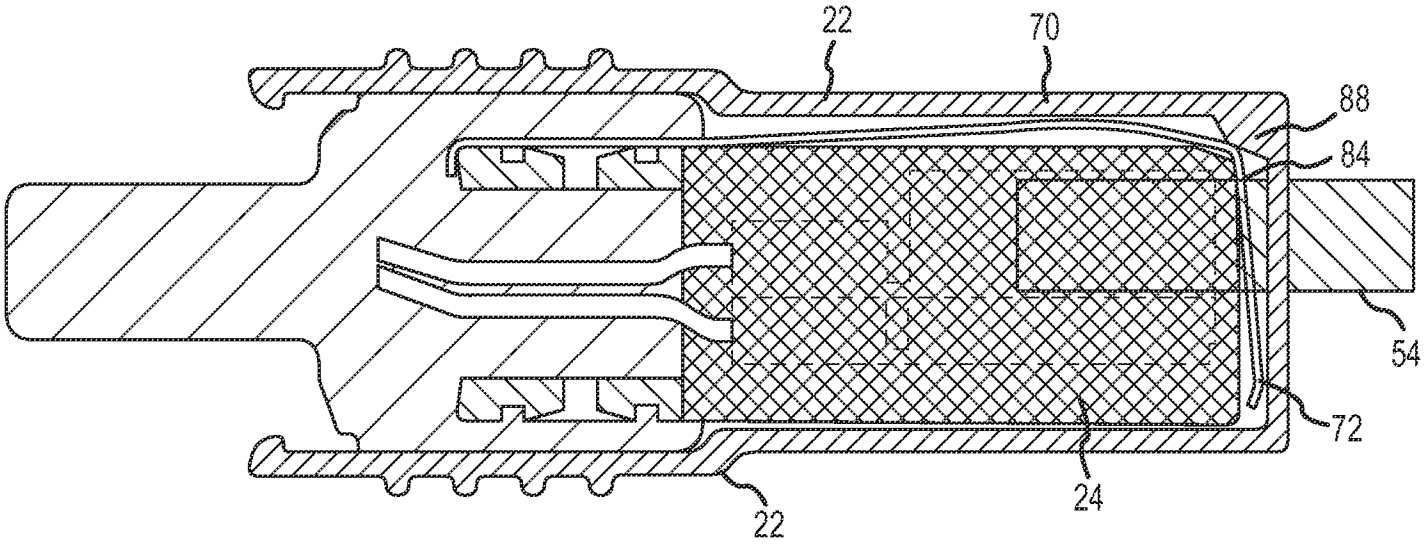
Figure 4C:
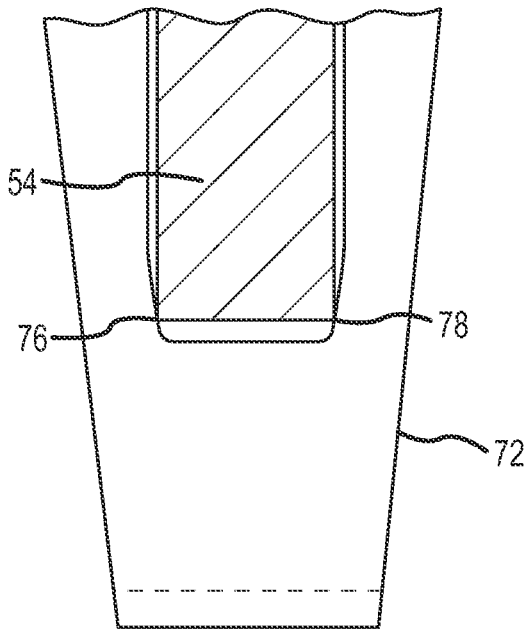

FIGS. 4A-4C illustrate an alternative embodiment of a spring prong retainer 70. This alternative embodiment of a spring prong retainer 70 may be employed in a similar type locking receptacle as that described above with respect to FIGS. 2A-3B. In this regard, elements which are substantially similar to those described above with respect to FIGS. 2A-3B will be described with the same reference numeral used in FIGS. 2A-3B.

In the embodiment described above and illustrated by FIGS. 2A-3B, the retention gripping points of the spring prong retainer 40 are along the flat, or semi-flat, surfaces of the narrow axis of the prong corresponding to the upper and lower surfaces of the aperture. That is, the aperture on the deflectable portion 60 of the spring prong retainer 40 may be rectangular in shape and the top and bottom of the rectangular opening may comprise the contact locations between the spring prong retainer 40 and the prong 54. Forces applied to those contact points are limited to the relationship of the precision of the prong dimensions to the aperture dimensions. As such, dimensional variations in the aperture or prong may reduce the ability of the spring prong retainer to grip the prong.

In the embodiment of FIG. 4A, an aperture 74 has a rectangular top and a bottom portion that narrows down or tapers. This design of the aperture 74 allows for contact between the spring prong retainer 70 and the prong 54 at a first location 76, a second location 78, and a third location 80 (see the exaggerated view in FIG. 4A and FIG. 4C) corresponding to locations on the top of the aperture 74 and on each of the sides at the bottom of the aperture 74 adjacent to the prong 54.

A significant increase in the gripping force is possible due to the amplification of the clamping force not only via the angular displacement of the deflectable portion 72, but also due to the wedging effect between the first location 76 and the second location 78 at each corner of the lower portion of the aperture 74. As a withdrawal force is exerted on the hook tab 82 of the spring prong retainer 70 where attached to the contact carrier module 24 (not shown in FIG. 4A), an initial action occurs as described for the spring prong retainer 40 in FIGS. 2A-3B. After the initial contact is made at the first location 76, second location 78, and third location 80 during the attempt to withdraw the prong 54, the forces applied to the prong 54 are amplified by the inclined planes adjacent to the first location 76 and second location 78 at the lower portion of the aperture 74. The tension force formed in the early stage of gripping by the axial displacement of the deflectable portion 72 of the spring prong retainer 70 about the fulcrum point 84 is amplified greatly to apply a compressive force at the points of contact of the prong 54 and the spring prong retainer 70 corresponding to the first location 76, the second location 78, and the third location 80. This force is multiplied by about 10 to 1 due to the tension amplification corresponding to the lever arm created by the deflectable portion 72 about the fulcrum 84. A total force amplification of about 80 times can be achieved by this method. It should be appreciated that by adjusting the angles of the inclined planes adjacent to the first and second locations 76 and 78, and the geometry of the spring prong retainer 70 adjacent to the fulcrum 84, various amplifications of force can be achieved. It should also be appreciated that by varying the amplification force, the spring prong retainer 70 can be tuned to optimally engage with a variety of mating prong materials and finishes.

Due to this amplification, and the relatively small contact area between the prong 54 and the first and second location 76 and 78, forces at least as high as 30,000 psi (30 Kpsi) in some embodiments are possible, thus ensuring positive gripping of the prong 54. It should be appreciated that use of this alternate method of prong capture may also be more tolerant of manufacturing variances in the prong 54.

FIG. 4B illustrates the release methodology for this alternate spring prong retainer 70, which is shown in a cross sectional view of a locking receptacle employing the spring prong retainer 70. As force is applied to the deflectable portion 72 of the spring prong retainer 70 by the lock release grip 22 (e.g., due to relative axial movement of the contact carrier module 24 and the lock release grip 22 when axial compression is applied thereto as described above with respect to FIGS. 3A-3B), the deflectable portion 72 of the spring prong retainer 70 becomes more perpendicular to the prong 54. In turn, the point of contact at the fulcrum point 84 is disengaged and the prong 54 would normally be free to be extracted, as described for the spring prong retainer 40 of previous embodiments. However, at this point the lower contact points adjacent to the first location 76 and second location 78 (best illustrated in the exaggerated view of FIG. 4A and FIG. 4C) may have the prong 54 captured therebetween. Small deflections of the metal of the prong 54 may occur adjacent to those locations when a release force is applied due to the wedging effect at the first location 76 and second location 78. Therefore, the prong 54 may therefore not be fully released when the deflectable portion 72 is disposed perpendicular to the prong 54. However, as the lock release grip 22 causes the deflectable portion 72 of the spring prong retainer 70 to deflect toward the substantially perpendicular position relative to the prong 54, a molded-in ramp 88 in the lock release grip 22 may act to push the spring prong retainer 70 down, which in turn results in movement of the first and second locations 76 and 78 away from the prong 54 to disengage any portion thereof impinging on the prong 54. Eventually, the entire spring prong retainer 70 is disengaged from the prong 54 such that the prong 54 may be removed from the contact carrier module 24.

It should be appreciated that the shape of the spring prong retainer 70 (best seen in FIG. 4A) contributes to the disengagement characteristics as well. The shoulders 90 of the spring prong retainer 70 are placed such that, upon force being applied to the spring prong retainer 70 to release as described above, the shoulders 70 contact the interior surface of the lock grip release 22. Continued rotation of the deflectable portion 72 of the spring prong retainer 70 in a direction toward perpendicular to the prong 54 results in the entire deflectable portion 72 of the spring prong retainer 70 to be forced down. This action, in conjunction with the action of the ramp 88 cast into the lock grip release 22 results in force on the spring prong retainer 70 urging the spring prong retainer 70 to disengage the prong 54 adjacent to the first location 76 and the second location 78.

Figure 5:
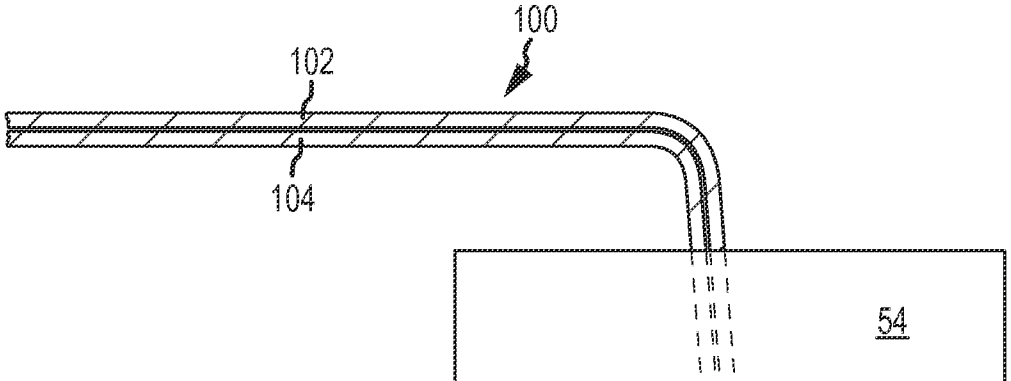
FIG. 5 illustrates another embodiment of a locking spring prong retainer in a release configuration.
Figure 6:
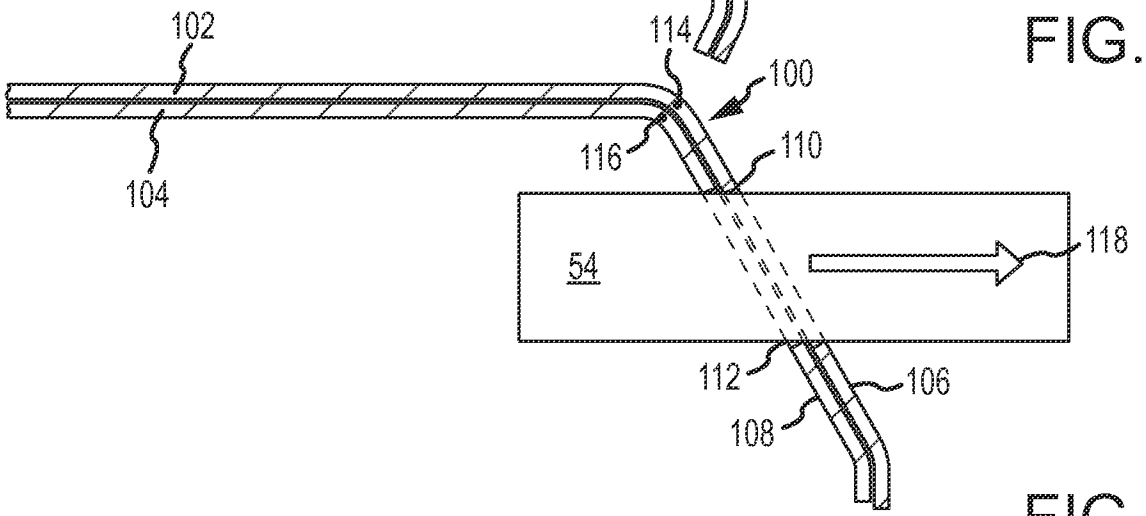
FIG. 6 illustrates the embodiment of FIG. 5 in a clamping configuration.

Another embodiment of a spring prong retainer 100 shown in FIGS. 5 and 6. This dual spring prong retainer 100 may be used in locking receptacles such as those described above with respect to FIGS. 2A-4C. In FIG. 5A, the spring prong retainer 100 is disposed in a release position such that a prong 54 that has been advanced into a receptacle associated with a contact carrier module (not shown in FIGS. 5A and 5B to preserve clarity) may be withdrawn with respect to the spring prong retainer 100. In FIG. 5B, the spring prong retainer 100 is in a clamping position such that a withdrawal force 118 imported between the prong 54 and receptacle (not shown) may be resisted by way of clamping engagement of the spring prong retainer 100 with respect to the prong 54. In this regard, the spring prong retainer 100 may function in a similar manner as the embodiments of spring prong retainers (e.g., 40, 70) discussed above in that movement of the spring prong retainer 100 into a substantially perpendicular relationship with respect to the prong 54 may allow for the withdrawal of the prong 54 from the from a contact carrier module (not shown). Accordingly, similar release mechanism as those described above may be used in combination with the spring prong retainer 100 as well. Also, like in the foregoing embodiments, the spring prong and 100 may deflect from the substantially perpendicular position with respect to the prong 54 in order to clamping ring gauge the prong 54.

However, the spring prong retainer 100 may differ from the foregoing embodiments in that the spring prong retainer 100 may include a first portion 102 and a second portion 104. Each individual one of the first portion 102 and second portion 104 may comprise a similar structure as the individual spring prong retainers discussed above. The embodiment of the spring prong retainer 100 shown includes the first portion 102 disposed in a stacked arrangement with the second portion 104. The first portion 102 may be bonded to the second portion 104 along at least a portion of the length of the first and second portions 102 and 104. Alternatively, the first portion 102 and the second portion 104 may be constrained so as to maintain the stacked orientation of the portions (e.g., by a contact carrier module, strain relief portion, etc), but not bonded together. The first portion 102 may include a first aperture 110 on a first deflectable portion 106 thereof. The second portion 104 may include a second aperture 112 on a second deflectable portion 108 thereof. The first and second deflectable portions 106 and 108 may also be generally disposed in a stacked relationship. The first and second deflectable portions 106 and 108 may be disposed for relative movement along their lengths. As such, when in the release position shown in FIG. 5A, wherein the first and second deflectable portions 106 and 108 are arranged substantially perpendicular to the prong 54, the first aperture 110 and the second aperture 112 may be aligned in the release position. In this regard, the alignment of the first aperture 110 and second aperture 112 may allow a prong 54 to be passed through the aligned apertures 110 and 112. That is, the collective opening presented by the first aperture 110 and second aperture 112 may be sized to allow the prong 54 to pass freely when in the release position shown in FIG. 5A.

However, upon application of a withdrawal force 118 on the prong 54 may result in the first deflectable portion 106 and the second deflectable portion 108 being deflected in a direction of the movement of the prong 54 in a direction corresponding to the application of the withdrawal force 118. That is, the first deflectable portion 106 and the second deflectable portion 108 may begin to deflect away from the perpendicular arrangement shown in FIG. 5A such that the first and second deflectable portions 106 and 108 deflect toward the position shown in FIG. 5B.

The first deflectable portion 106 may have a first fulcrum point 114 and the second deflectable portion 108 may have a second fulcrum point 116. The first and second fulcrum points 114 and 116 may be offset due to the stacked arrangement of the portions 102 and 104. In this regard, upon deflection of the first and second deflectable portions 106 and 108 in direction corresponding to the withdrawal force 118, the first deflectable portion 106 and second deflectable portion 108 may experience slightly different angles of deflection. As such, upon deflection, the deflectable portions 106 and 108 may move with respect to one another along the lengths of the deflectable portions 106 and 108. A shear force may be generated at the interface of the two deflectable portions 106 and 108 as they move relative to one another. The first aperture 110 and the second aperture 112 may also become offset as a result of the relative movement of the first and second deflectable portions 106 and 108. This may result in the constraining of the effective aperture opening size defined by a collective cross section of the first aperture 110 and the second aperture 112. That is, the aperture size presented in cross-section with respect to the prong 54 may be reduced and the first and second deflectable portions 106 and 108 may impart a clamping force onto the prong 54 by way of the sheer force resultant from the relative movement between the first and second deflectable portions 106 and 108.

The spring prong retainer 100 may generate a shear force upon small movements of the prong 54 in a direction corresponding to the withdrawal force 118. Additionally, such an arrangement may be able to impart large clamping forces which may be much higher than the mechanical limits of the cord, plug, and/or receptacle associated with the spring prong retainer 100. Additionally, such an arrangement may provide for a greater tolerance for dimensional variances between the prong 54 and the apertures 110 and 112 (i.e., the clamping action of the spring prong retainer 100 may not rely on close dimensional tolerances between the prong and aperture). Rather, the mechanical griping action (e.g., resulting from the constriction of the effective aperture cross section defined by the first and second apertures 110 and 112) and the resultant clamping force imparted may be amplified by the shear differential of the apertures 110 and 112. In this regard, the application of the clamping force by way of the shear action of the first and second deflectable portions 106 and 108 may not require tolerances that are as closely matched between the apertures 110 and 112 and the prong 54 as those of other embodiments of spring prong retainers (e.g., 40, 70) discussed above. The relative movement of the first deflectable portion 106 and second deflectable portion 108 that may result in an offsetting of the first and second apertures 110 and 112 may result in an offset coaxial compression at tangent bearing points of the first and second deflectable portions 106 and 108 on the prong 54. This coaxial compression may be applied at four locations corresponding with the top and bottom surfaces of the first and second apertures 110 and 112 respectively.

The embodiment of the spring prong retainer 100 may be incorporated in a locking receptacle similar to those shown above. That is, the same or similar mechanisms shown in the embodiments above for disposing a deflectable portion of a spring prong retainer in the release position may be employed with the spring prong retainer 100 depicted in FIGS. 5 and 6.

Various characteristics of the locking electrical receptacle of the present invention can be varied to control the release stress of the locking electrical receptacle. In this regard, the geometry, thickness, material qualities and detail shaping of the gripping component can be used to control the release tension of the locking mechanism. As an example, increasing the thickness and/or stiffness of the material of the gripping component increases the release tension of the locking mechanism.

Figure 7:
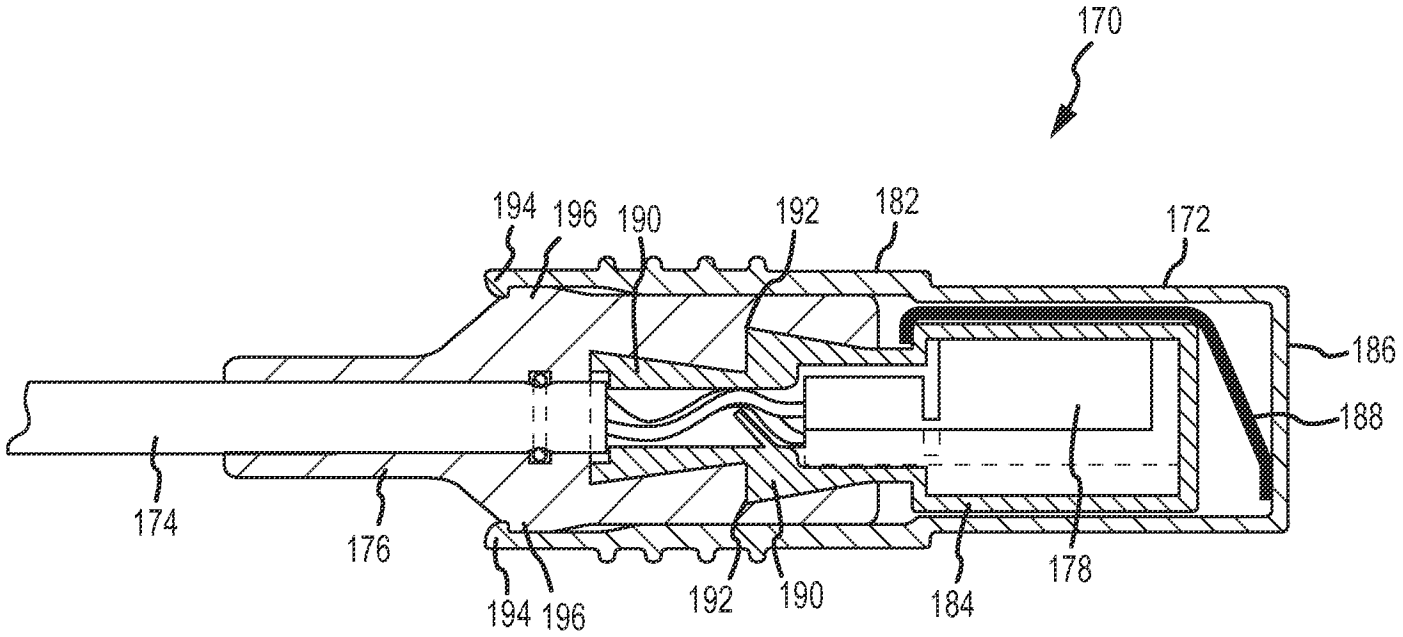
FIG. 7 illustrates another embodiment of a locking electrical receptacle including an embodiment of a strain relief mechanism.

FIG. 7 depicts another embodiment of a locking receptacle 170 which features a strain release mechanism for releasing the lock upon prong of the plug when a tension force above a predetermined valve of tension is applied to a connected receptacle and plug. The locking receptacle 170 may be similar in operation to that described above with respect FIGS. 2A through 4C in that a plug may be inserted into the locking receptacle 170 and may be clampingly engaged by a spring prong retainer 172. The spring prong retainer 172 may be disposed in a clamping position by deflection away from a position substantially perpendicular with respect to an inserted prong that results in the spring prong retainer 172 being disposed in a clamping position. Additionally, movement of the spring prong retainer 172 into a substantially perpendicular position with respect to inserted prong results in the spring property in 172 being positioned in a release position.

As described above, the locking receptacle 170 may be used to connect a prong 198 (shown in FIGS. 8A-8D) of a plug in electrical communication with a receptacle 178. A cord 174 extending from the receptacle 170 may feature an over molded strain relief portion 176. The strain relief portion 176 may be disposed relative to a telescopic outer grip 182. The outer grip 182 may be moved relative to the strain relief portion 176 and a contact carrier portion 184 such a face 186 of the outer grip portion 182 may act on a deflectable portion 188 of the spring prong retainer 172 to dispose the spring prong retainer 172 in a release position as discussed above.

The strain relief mechanism according to the embodiment shown in FIG. 7 allows for relative axial movement between a first and second portion (e.g., the contact carrier module 184 and the strain relief portion 176). This relative axial movement may be sufficient to facilitate engagement of the deflectable portion 188 of the spring prong retainer 172 to dispose the deflectable portion 188 into a release position. The relative axial movement between the portions may be facilitated by an elastic member. The elastic member may exhibit an effective spring rate. That is, for a given force applied to the cord, the two portions may deflect a given distance. As such, the ability to control the tension value at which the deflectable portion 188 is disposed in a release position may be controlled by varying the geometry, dimensions, or material of the elastic material.

For example, as depicted in FIG. 7, the contact carrier portion 184 may define a number of inclined planes 190 with correspondingly shaped steps 192 defined by the strain relief portion 176. Upon application of force to the cord 174, the strain relief portion 176 may begin to move with respect to the contact carrier 184. That is, the incline planes 190 may begin ride along the correspondingly shaped steps 192, thus allowing for axial relative movement of the strain relief portion 176 and the contact carrier 184. However, the geometry of the inclined planes 190 and steps 192 may resist such relative movement and bias the strain relief portion 176 and the contact carrier 184 into a contracted relative axial position as shown in FIG. 7. Upon application of sufficient force (e.g., above a threshold tension value) to the cord 174, the inclined planes 190 of the contact carrier module 184 may slide along the correspondingly shaped steps 192 of the strain relief portion 176. This may result in the strain relief portion 176 adjacent to the steps 192 being forced away from the portion of the contact carrier 184 defining the inclined planes 190 and generally against the outer grip portion 182. As such, tabs 196 defined in the strain relief portion 176 may engage hooks 194 on the outer grip portion 182. In this regard, the outer grip portion 182 may also be moved axially relative to the contact carrier module 184 in a direction corresponding to the force acting on the cord 174 to withdrawal the prong and receptacle 170 from engagement.

Because the spring prong retainer 172 is fixed relative to the contact carrier module 184 (e.g., attached thereto) in the embodiment depicted in FIG. 7, the result may be the outer grip portion 182 being moved relative to the spring prong retainer 172 as the contact carrier 184 and strain relief portion 176 begin to move axially relative to one another. As a result of the spring prong retainer 172 may be moved into the release position such a prong that is clampingly engaged by the spring prong retainer 172 is released.

Accordingly, the amount of tension needed to be applied to the cord 174 in order to move the strain relief portion 176 sufficiently to engage the spring prong retainer may be controlled by the properties and interaction of the inclined planes 190 and correspondingly shaped steps 192. In this regard, the relative axial movement of the contact carrier module 185 and strain relief portion 176 may be influenced by the material type, the geometry of the interface between the contact carrier 184 and the strain relief portion 176, etc.

Figure 8A:
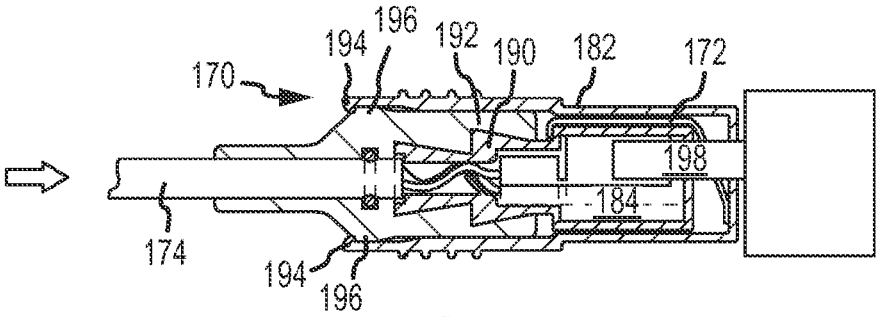
FIGS. 8A-8D illustrate a progression of operation of the embodiment shown in FIG. 7.
Figure 8B:
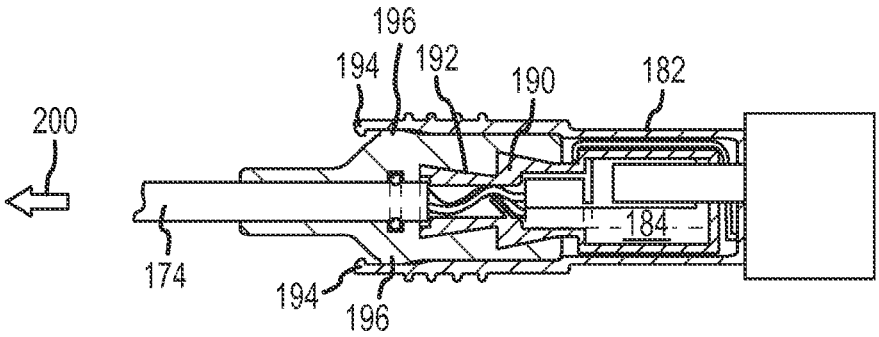
Figure 8C:
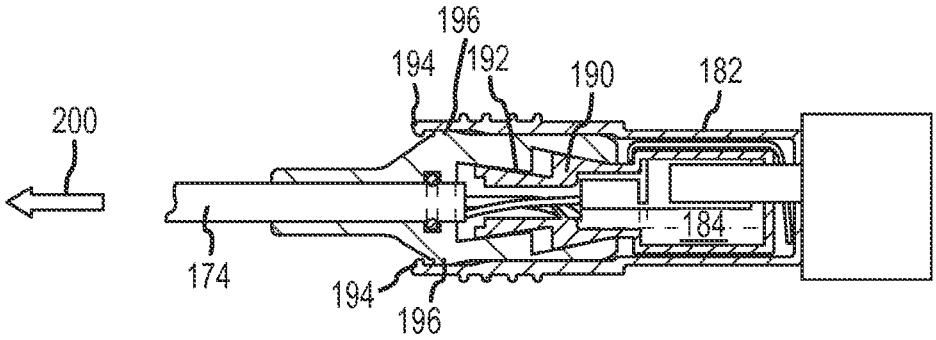
Figure 8D:
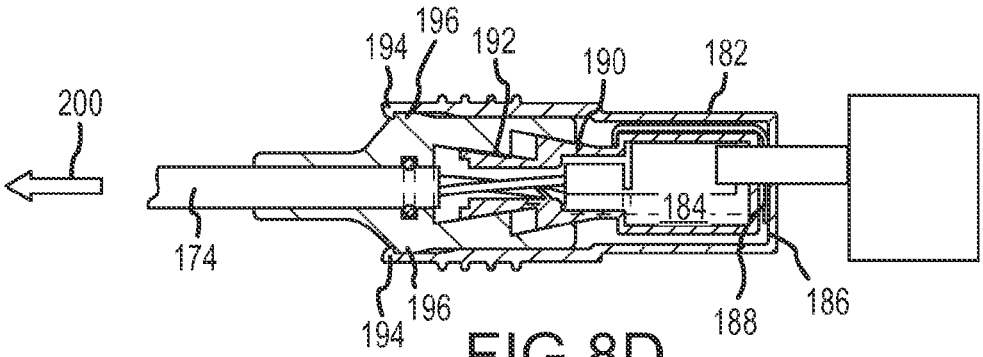

FIGS. 8A-8D show one such sequence wherein tension above a certain threshold is applied to the cord 174 resulting in release of a prong 198. In FIG. 8A, a prong 198 is clampingly engaged by a spring prong retainer 172 as the locking receptacle 170 is advanced onto the prong 198. A withdrawal force 200 may be applied to the cord 174 as shown in FIG. 8B. As the withdrawal force 200 grows larger (represented in FIGS. 8B-8D as increasingly larger arrows), the inclined planes 190 of the contact carrier module 184 begin to move along the correspondingly shaped steps 192 of the strain relief portion 176. As such, the tabs 196 of the over molded portion 176 may engage hooks 194 of the outer grip portion 182. As the contact carrier portion 184 may be locked in engagement with the prong 198, the withdrawal force 200 applied to the cord 174 may not result in any movement of the contact carrier portion 184 with respect to prong 198. However, when the tabs 196 of the over molded portion 176 contact the hooks 194 of the outer grip portion 182, the outer grip portion 182 may begin to be withdrawn in the direction of the withdrawal force 200 as well. In this regard, as shown in FIG. 8D, as the withdrawal force 200 continues to grow, the face 186 of the outer portion 182 may act upon the deflectable portion 188 of the spring prong retainer 172 to urge the spring prong retainer 172 into the release position. As such, the prong 198 may be released by the spring prong retainer 172 such that the prong 198 is withdrawn from the contact carrier module 184. The action of the inclined planes 192 and the correspondingly shaped steps 192 may bias the strain relief portion 176 and the contact carrier module 184 into a retracted position with respect to one another. Thus, upon removal of the locking receptacle 170 from the prong 198, the engagement of the inclined planes 190 with respect to the correspondingly shaped steps 192 may urge the contact carrier module 184 and strain relief portion 176 back into engagement such that the inclined planes 190 and steps 192 are again as shown in FIGS. 7 and 8A.

In this regard, the material of the contact carrier module 184 and/or strain relief portion 176 may be formed from an elastic material adjacent to the respective portions thereof defining the steps 192 and inclined planes 190. In this regard, relative movement of the contact carrier module 184 with respect to the strain relief portion 176 may result in the shape of the inclined planes 190 and corresponding steps 192 acting to urge the over molded portion 176 outwardly. Thus the engagement of the hooks 194 by the tabs 196 may be further enhanced by way of the outward pressure resulting from the slipping of the inclined planes 190 with respect to the steps 192.

In one embodiment, the locking receptacle 170 may be designed such that approximately forty pounds of withdrawal force on the cord 174 may result in the activation of the release mechanism described above such that the spring prong retainer 172 is disposed in the release position and the prong 198 retained by the spring prong retainer 172 is released.

Figure 9A:
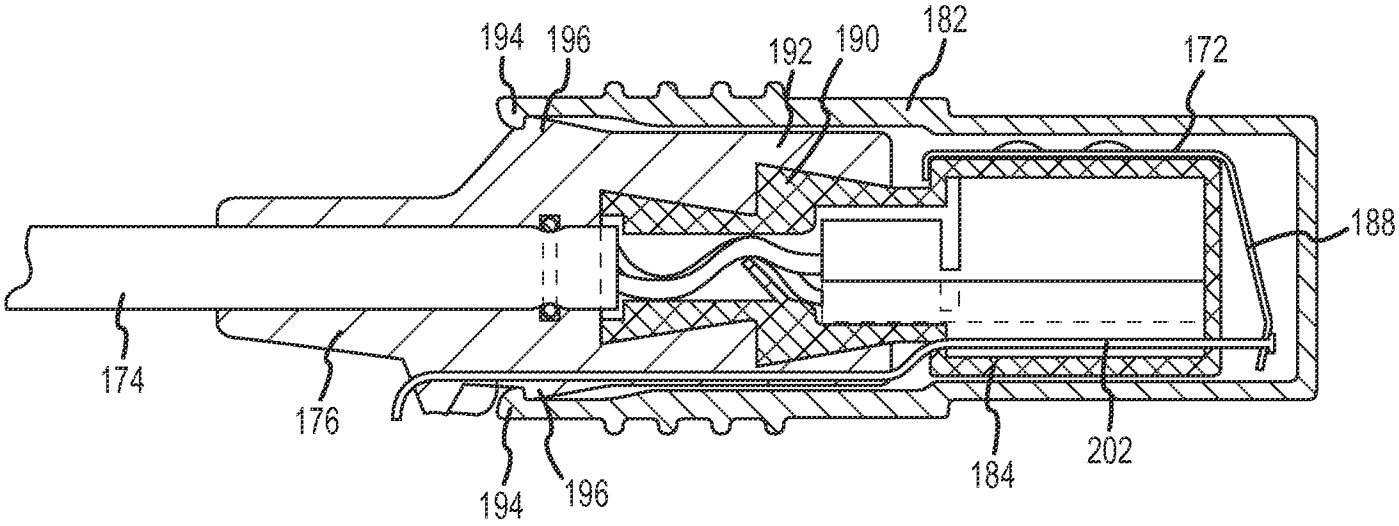
FIGS. 9A-9C illustrate various embodiments of locking electrical receptacles including various different embodiments of strain relief mechanisms.

In FIG. 9A, another strain release mechanism similar to those shown in FIGS. 7 and 8A-8D is shown that additionally includes a rigid member in the form of a direct pull rod 202. As can be appreciated, the direct pull rod 202 shown in FIG. 9 may be employed in conjunction with the inclined planes 190 and correspondingly shaped steps 192 described above. The direct pull rod 202 may, at a first end thereof, be held rigidly by the strain relief portion 176. The other end of the direct pull rod 202 may engage a portion of the deflectable portion 188 of the spring prong retainer 172. Thus, as the strain relief portion 176 begins to move axially relative to the contact carrier module 184 as described above in the sequence of FIGS. 8A-8D, the direct pull rod 202 may move along with the strain relief portion 176. This may result in the end of the direct pull rod 202 acting on the deflectable portion 188 to move the deflectable portion 188 into the release position. Thus, the direct pull rod 202 may also act to dispose the deflectable portion 188 of the spring prong retainer 172 and a release position. Such a direct pull rod 202 may be used in conjunction with or in lieu of the contact of the inner wall of the outer grip portion 182 on the deflectable portion 188.

Figure 9B:
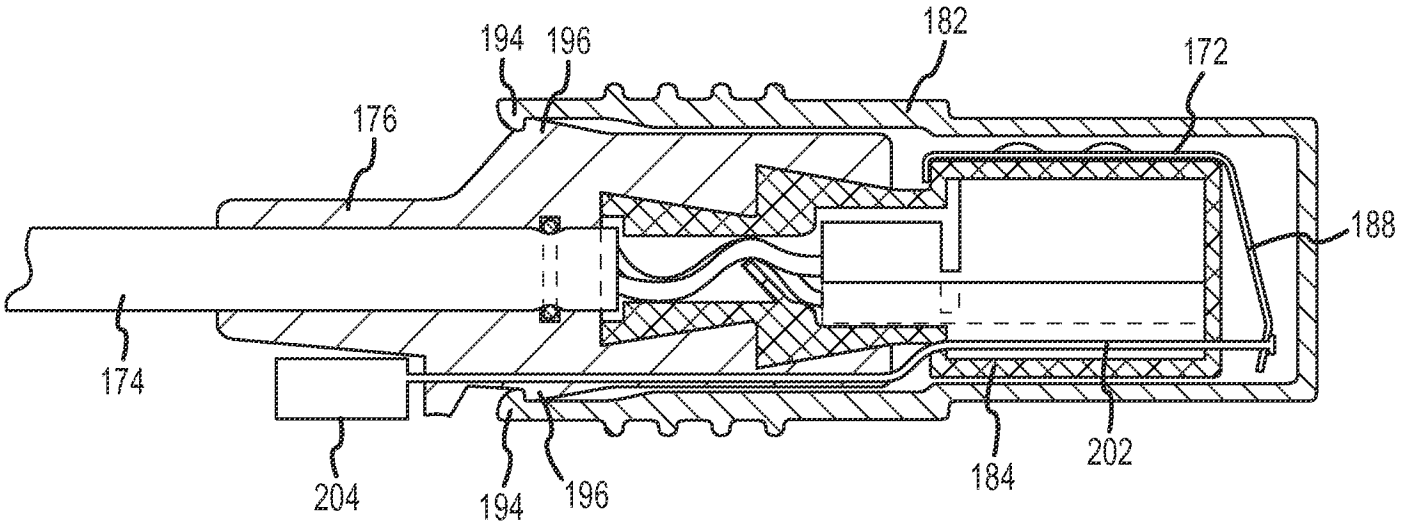
Figure 9C:
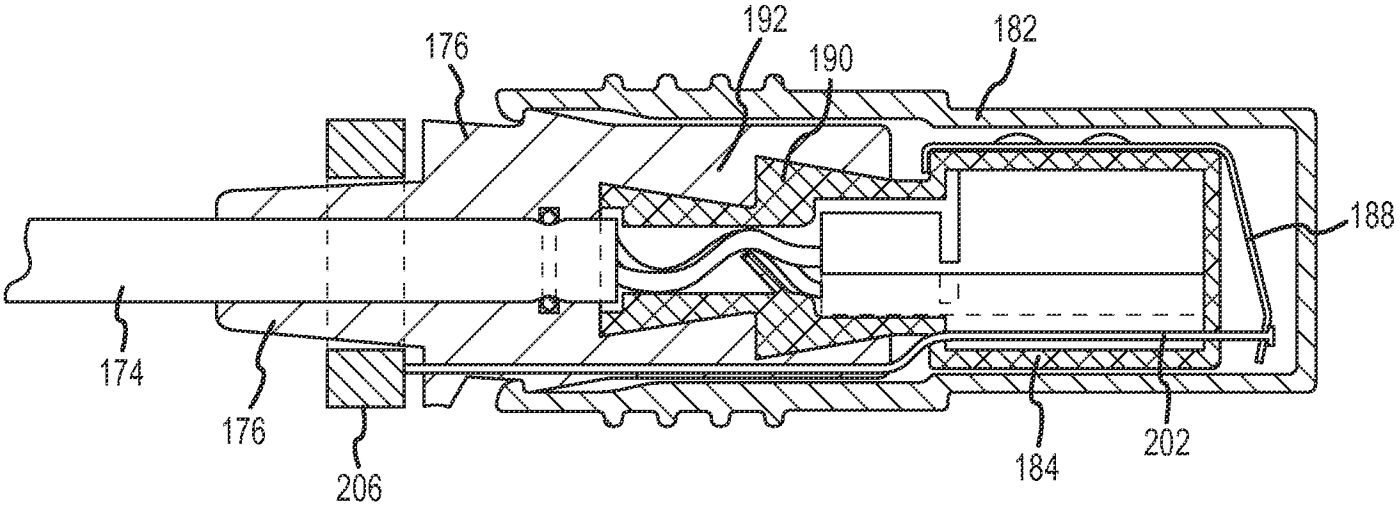

Additionally, as shown in FIG. 9B, a pull knob 204 may be provided on the end of the rod 202 engaged by the over molded portion 176. The pull knob 204 may protrude from the rear of the over molded portion 176 such that a user may access the pull knob 204 when the locking receptacle is engaged with a plug. In this regard, in addition to the direct pull rod 202 being acted on upon withdrawal of the over molded portion 176 with respect to the contact carrier module 184, the pull knob 204 may allow a user to manually manipulate the direct pull rod 202 to release a prong from the locking receptacle 170 by movement of the deflectable portion 188 of the spring prong retainer 172 into the release position even when tension force above the predetermined value is not applied. Further still, as shown in FIG. 9C, an end of a direct pull rod 202 may include a pull collar 206. The pull collar 206 may also be directly manipulated by user to release a prong or may be engaged by the strain relief portion 176 when excessive strain is introduced to retract the direct pull rod 202 and dispose the deflectable portion 188 in a release position.

Figure 10A:
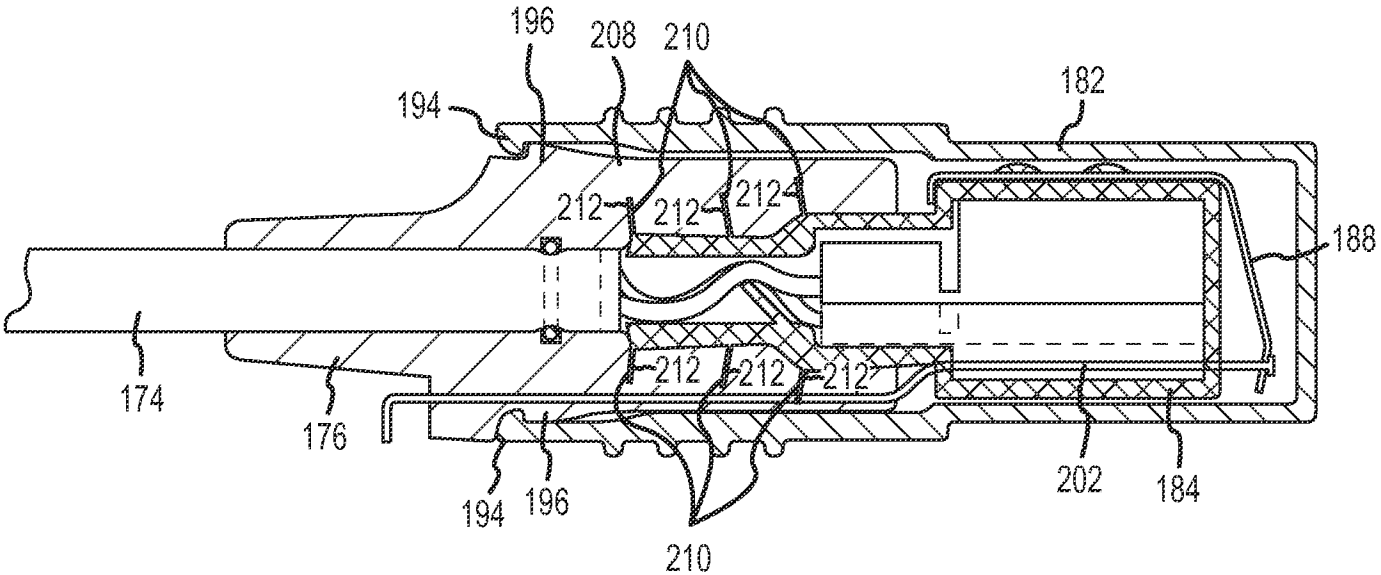
FIGS. 10A-10C illustrate additional various embodiments of locking electrical receptacles including additional embodiments of a strain relief mechanisms.

FIG. 10A depicts an alternative embodiment of a locking receptacle wherein the interface between the strain relief portion 176 and the contact carrier module 184 defines a contact carrier elastomeric portion 208. The contact carrier elastomeric portion 208, like the correspondingly shaped inclined planes 140 and steps 192, allows for relative axial movement between the contact carrier module 184 and the strain relief portion 176 at a given applied tension value. The relative axial movement allows the strain relief portion 176 to engage the outer grip portion 182 and/or a direct pull rod 202 to act upon the deflectable portion 188 to dispose the spring prong retainer 188 into the release position as described above.

The contact carrier elastomeric portion 208 may comprise an interface between the contact carrier 184 and the strain relief portion 176. The contact carrier portion 184 may include a plurality of wings 210 extending from the contact carrier portion 184. The wings 210 may engage corresponding grooves 212 formed or molded in the strain relief portion 176. The wings 210 and/or groves 212 may be made of elastomeric material which allows for selective slipping between the contact carrier portion 184 and the strain relief portion 176 when an axial strain is applied to the locking receptacle. As in the previously discussed embodiments, the size, shape, material, etc of the wings 210 and grooves 212 may be adjusted or modified to produce different amounts of relative movement between the contact carrier portion 184 and the strain relief portion 176 upon application of different amounts of axial strain with respect to the plug to the locking receptacle.

Figure 10B:
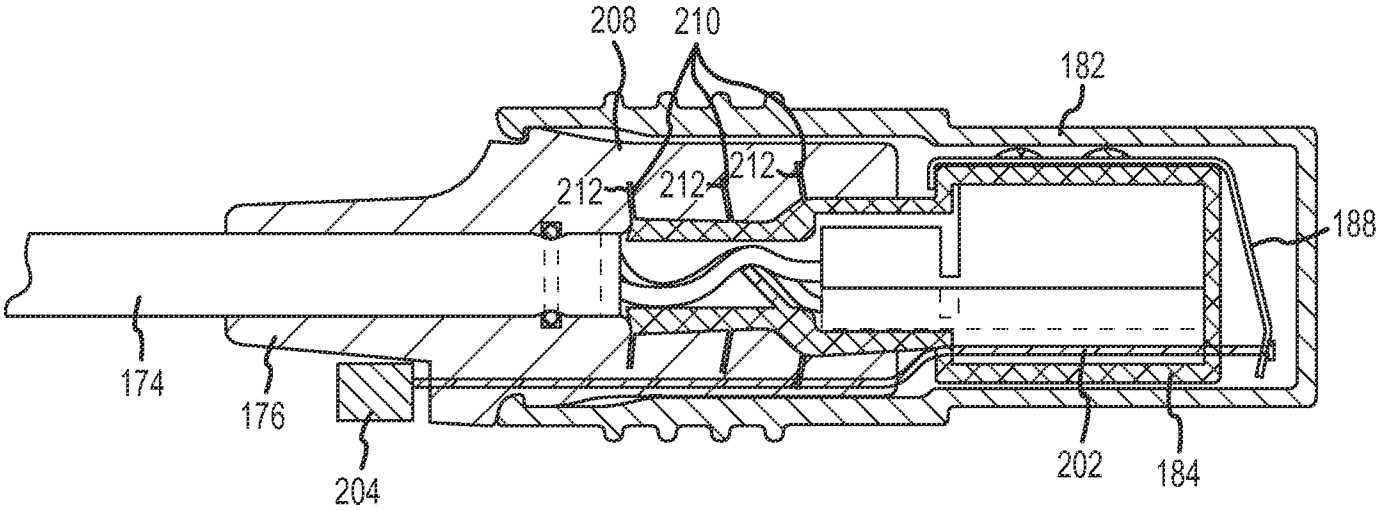
Figure 10C:
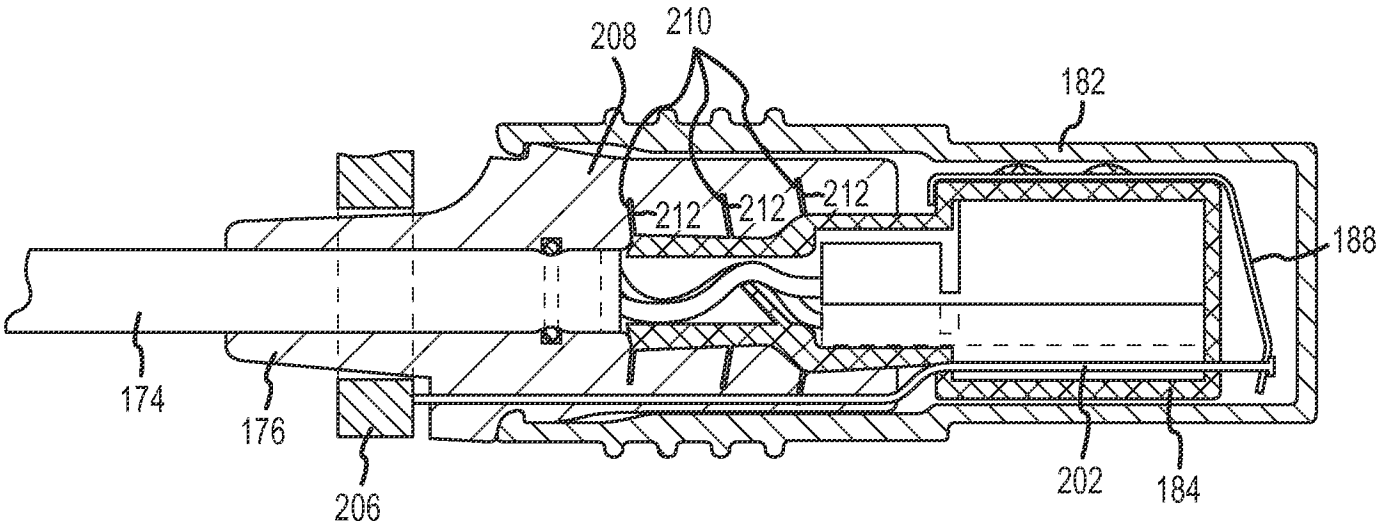

As depicted in FIGS. 10A-10C, the embodiment of a locking receptacle employing a contact carrier elastomeric portion 208 may also include a direct pull rod 202. The direct pull rod, as described above, may be equipped with a pull knob 204 (shown in FIG. 10B) or a pull collar 206 (shown in FIG. 10C) similar to those described above.

In this regard, it will become apparent that any structure that allows controlled relative movement between the contact carrier 184 and strain relief portion 176 may be employed in a strain relief mechanism as described above. That is, any structure that allows for selective elastic movement of the strain relief portion 176 with respect to the contact carrier 184 may be employed. Such an elastic structure may exhibit a certain amount of resistance on the relative movement and move a predetermined distance once a predetermined force has been applied thereto (e.g., exhibit an effective spring rate) and bias the strain relief portion 176 and the contact carrier 184 in a retracted relative position. The resistance may be designed to program the tension at which the prong is released. A number of embodiments of alternative structures that may be used in this regard are presented below.

Figure 11A:
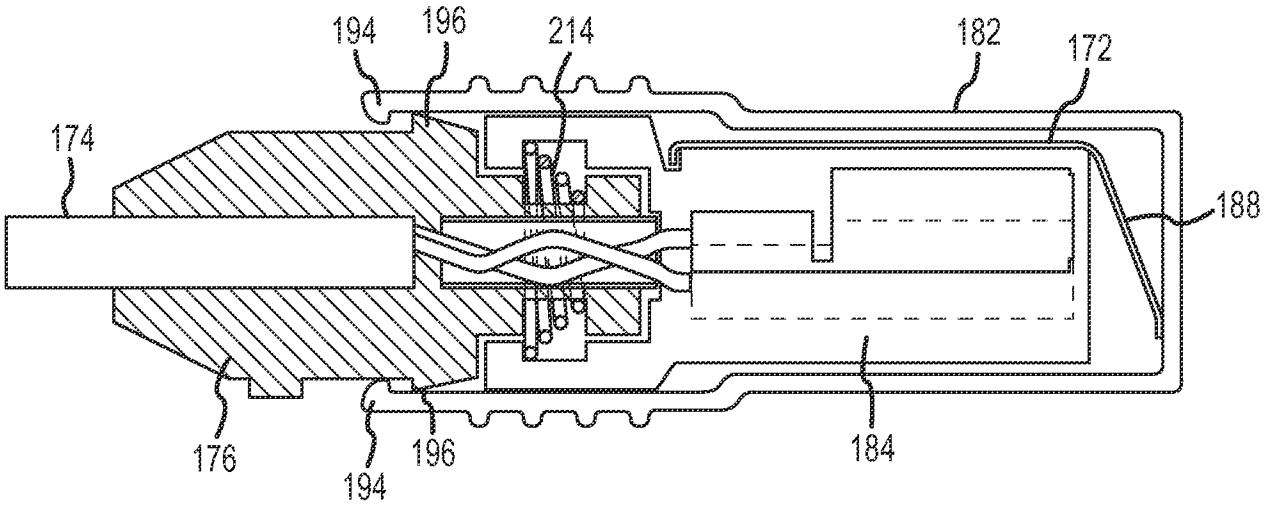
FIGS. 11A-12D illustrate cross sectional views of a locking electrical receptacle comprising various embodiments of elastic members for use in a strain relief mechanism.
Figure 11B:
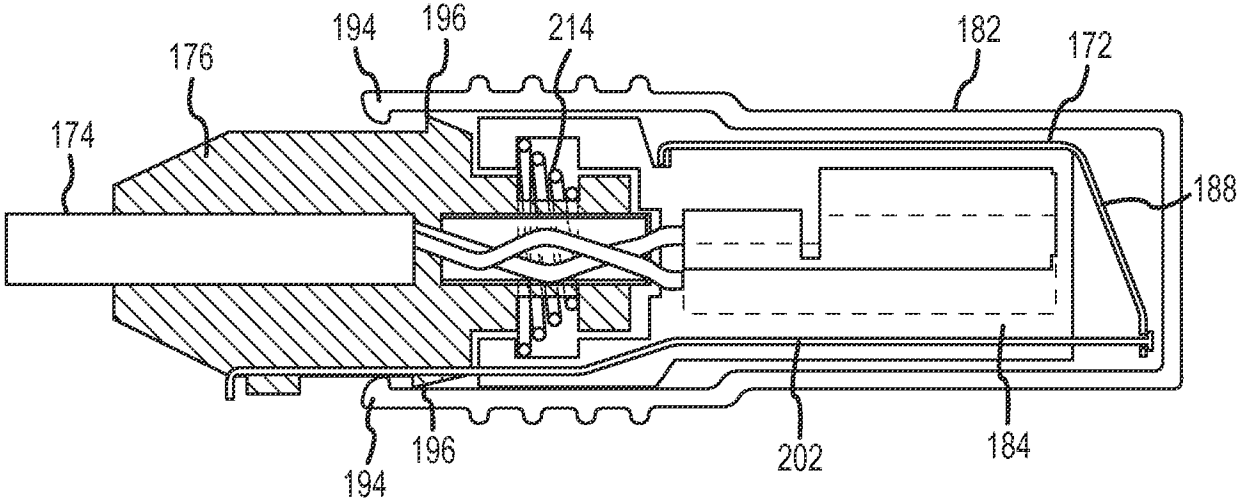

For instance, in FIG. 11A a coil spring 214 may be provided between the contact carrier module 184 and the strain relief portion 176. The coil spring 214 may allow for movement of the strain relief portion 176 with respect to the contact carrier module 184 upon application of the predetermined amount of withdrawal force. In this regard, the embodiment depicted in FIG. 11A may act in a manner as described to dispose the spring prong retainer 172 in a release position. FIG. 11B depicts another embodiment wherein a direct pull rod 202 may also employed as described above.

Figure 12A:
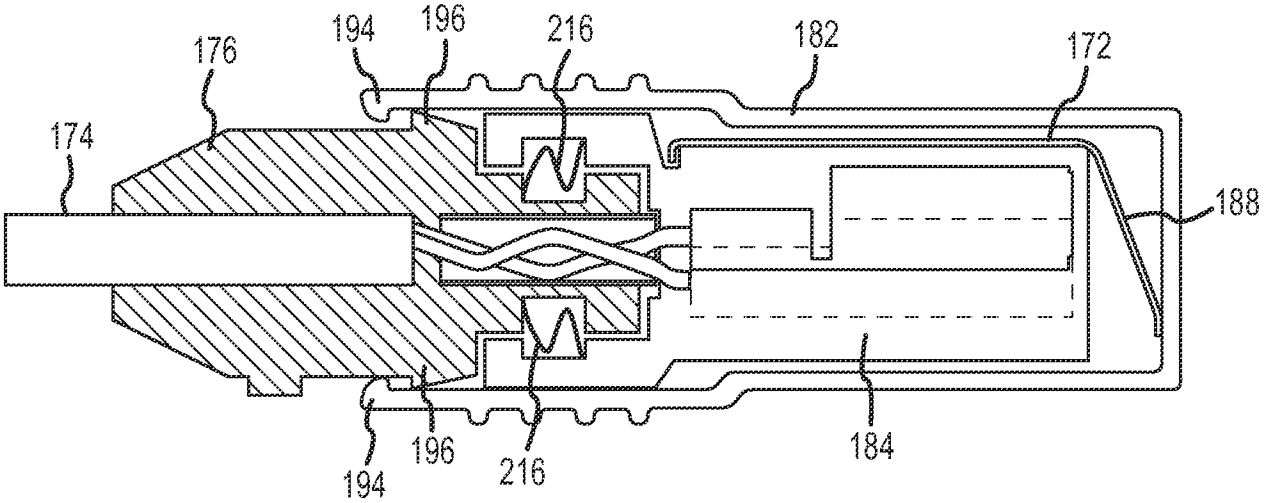
Figure 12B:
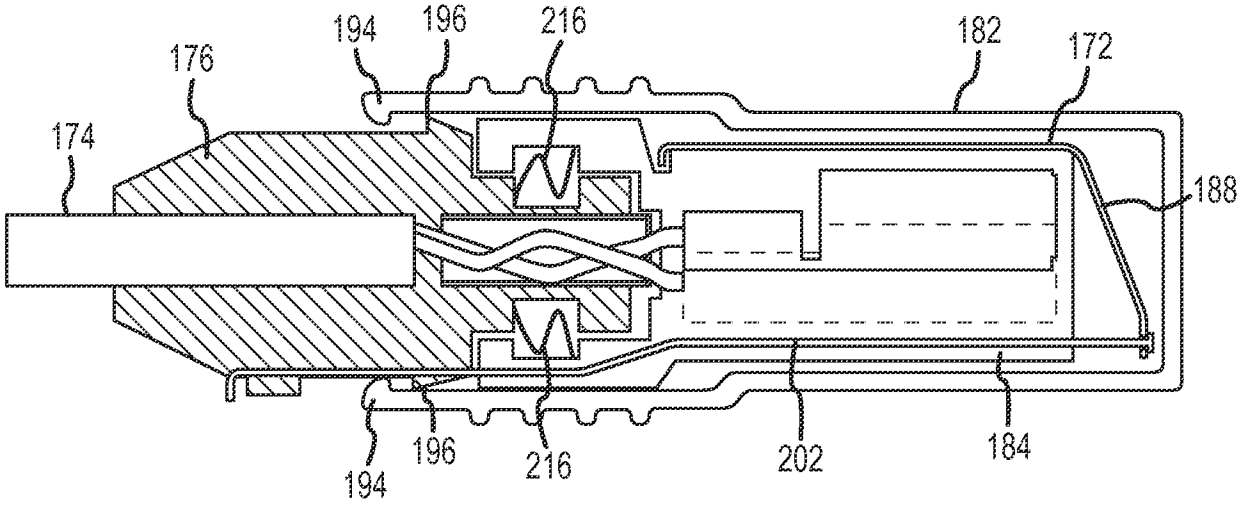
Figure 12C:
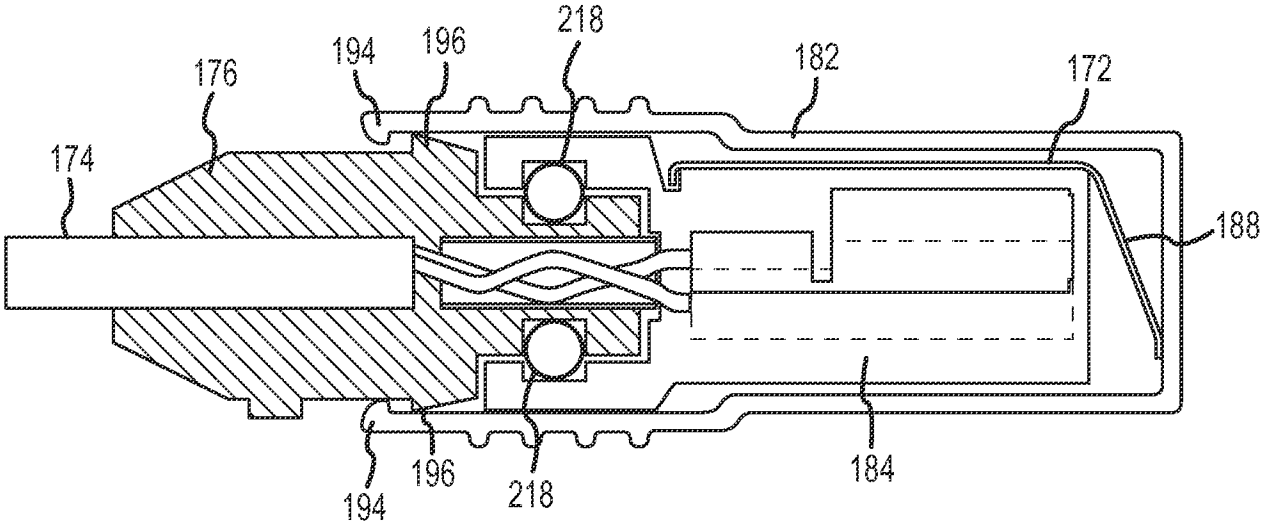
Figure 12D:
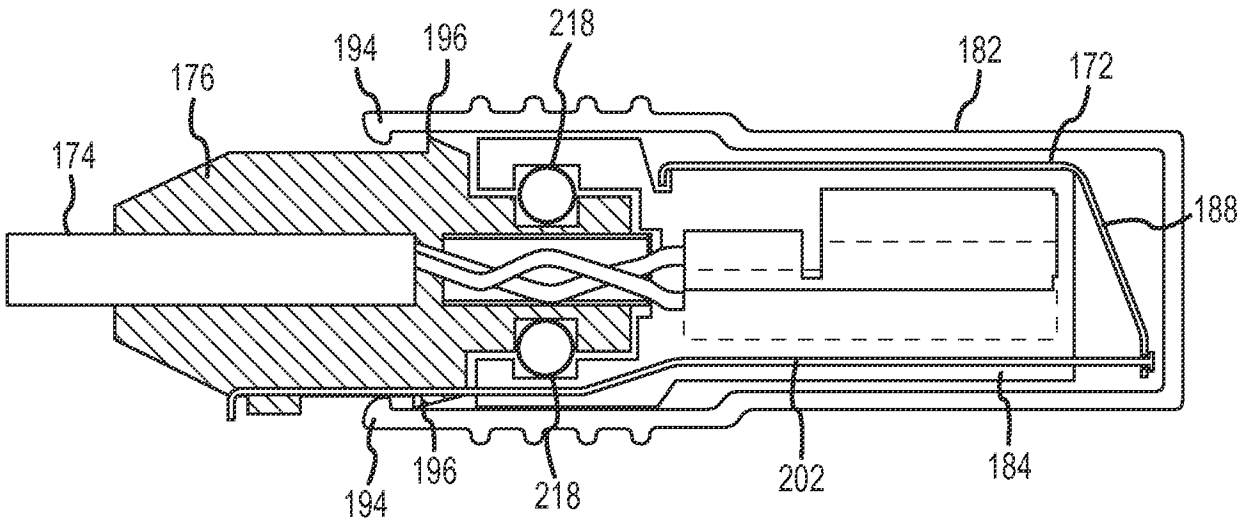

FIG. 12A shows yet another embodiment where one or more leaf springs 216 are provided that allows for relative movement of the strain relief portion 176 with respect to the contact carrier module 184. As shown in FIG. 12B, the embodiment shown in FIG. 12A may also be used with a direct pull rod 202. FIG. 12C depicts the use of a pneumatic spring 218 which allows for relative movement of the strain relief portion 176 with respect to the contact carrier module 184. The pneumatic spring 218 may be a compressed by cord tension that exerts a force sufficient to partially collapse the pneumatic spring 218. Thus, the pneumatic spring 218 may collapse or otherwise be deflected at a predetermined level of force which allows for the relative movement of the strain relief portion 176 and the contact carrier module 182. FIG. 12D depicts an embodiment according to FIG. 12C that also employs a direct pull rod 202 to also engage the spring prong retainer 172 into a release position.

Figure 13:
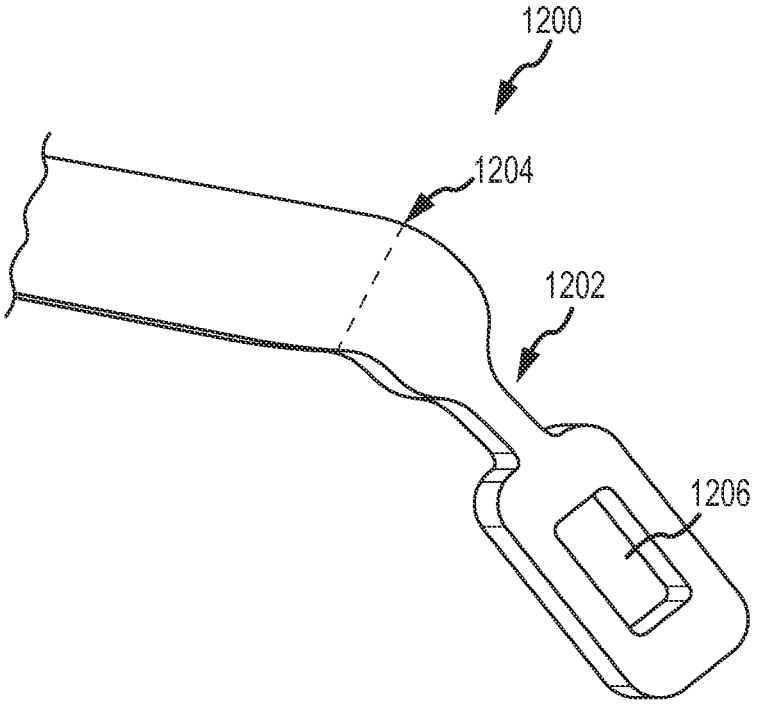
FIG. 13 illustrates a perspective view another embodiment of a spring prong retainer for use with a locking electrical receptacle.

The geometry of spring prong retainers may also be varied to provide improved safety and performance. FIG. 13 shows on example in this regard. The illustrated spring prong retainer 1200, which may be incorporated into, for example, the embodiments described above, includes a narrowed neck portion on 1202 between the flex point 1204 of the spring prong retainer 1200 and the prong engagement aperture 1206. This neck portion 1202 may provide a number of desirable functions. For example, the neck portion 1202 maybe positioned to provide greater clearance between the spring prong retainer 1200 and the other prongs of plug. In addition, the narrow portion 1202 may be designed to provide a defined breakpoint in the case of structural failure. That is, in the event breakage occurs due to stress or material fatigue, the neck portion 1202 provides a safe failure point that will not result in electrical hazards or failure of the electrical connection.

It can be appreciated that all of the retention mechanisms described herein that can have their release tension changed by varying their design parameters, can have a release tension that is coordinated with the receptacle design or a standard or specification so as to ensure that the cord cap or receptacle will not break resulting in a potentially hazardous exposure of wires. Thus, for example, it may be desired to provide a release stress of forty pounds based on an analysis of an end cap or receptacle structure, a regulatory requirement, or a design specification. The locking mechanism may be implemented by a way of a spring prong retainer as shown, for example, in FIGS. 2A-2B, 10A-10B and 11A-11B. Then, the material and thickness of the spring prong retainer as well as the specific geometry of the spring prong retainer or elastic member may be selected so as to provide a release stress of forty pounds of force. The values of these various design parameters may be determined theoretically or empirically to provide the desired release point.

Figure 14:
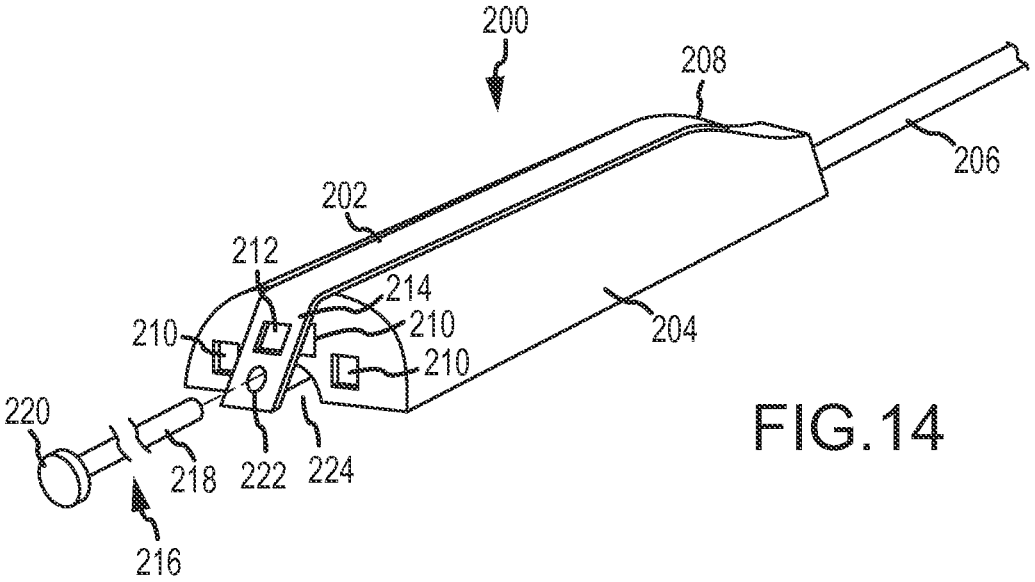
FIG. 14 illustrates an embodiment of a locking electrical receptacle including an embodiment of a release mechanism.

FIG. 14 depicts another embodiment of a locking electrical receptacle 200. The receptacle 200, like those described above, may include a spring prong retainer 202 positioned relative to a contact carrier module 204. The contact carrier module 204 may include a number of receptacles 210 for receiving prongs to establish electrical communication between the prong and a receptacle 210. The spring prong retainer 202 may include an aperture 212 through which a prong (not shown) may pass when the spring prong retainer is in a substantially perpendicular orientation with respect to the prong. In this regard, when he prong is urged in a direction associated withdrawal of the prong from the receptacle 210, the clamping portion 214 of the spring prong retainer 202 may deflect away from a substantially perpendicular position with respect to link the prong such that the spring prong retainer 202 prevents the prong from being withdrawn. In this regard, the clamping portion 214 of the spring prong retainer 202 may have a clamping position and a release position.

FIG. 14 depicts an embodiment of a locking electrical receptacle 200 including a release mechanism that may be used to urge the clamping portion 214 into the release position such that a prong may be withdrawn from the receptacle 210 free from a clamping action of the clamping portion 214. This embodiment of a release mechanism for urging the clamping portion 214 described below may be used alone or in conjunction with the telescoping lock release grip 22 described above with respect to FIGS. 2A-2B. The release mechanism, or at least a portion thereof, generally extends in a direction corresponding to the insertion of a plug into the receptacles 210. That is, the release mechanism extends away from an interface of the plug and receptacle 210. This may help to enable access by a user to the release mechanism when the receptacle 210 is engaged with a plug.

Figure 16A:
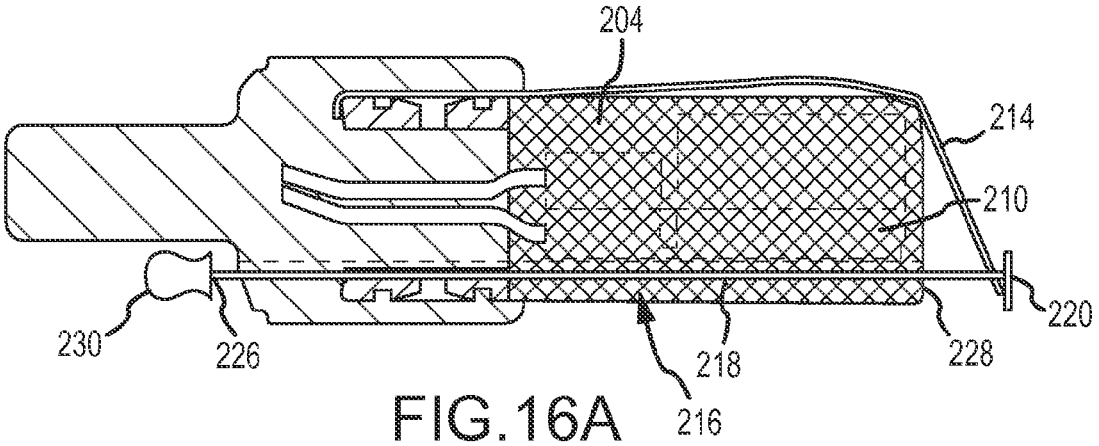
FIG. 16A-16B illustrate another embodiment of a locking electrical receptacle including embodiments of release mechanisms.

In this regard, a rod 216 may be provided. As shown in FIG. 16, the rod 216 is shown in an exploded position relative to the spring prong retainer 202 and the contact carrier module 204. The rod 216 may include a rod shaft 218 and a rod head 220. The rod head 220 may have a cross-section generally larger than that of the rod shaft 218. As such, the rod shaft 218 may be passed through a through hole 222, notch, or other type of relief on the clamping portion 214 of the spring prong retainer 202. The rod shaft 218 may also extend through a passage 224 such that the rod head 220 may contact the clamping portion 214 of the spring prong retainer 202 adjacent to the through hole 222 such that the rod shaft 218 generally extends away from the intersection of the receptacle 200 and a plug. As depicted, the passageway 224 is a channel defined in the contact carrier module 204. Alternative embodiments may include a through hole passage, notch, or other type of relief in the contact carrier module 204 which allows the rod shaft 218 to extend away from the interface of the receptacle and plug.

Figure 15A:
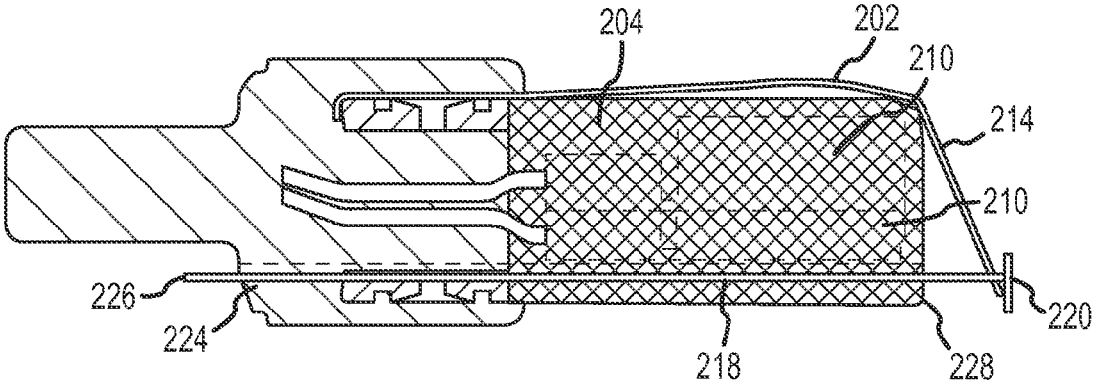
FIG. 15A-15B illustrate a cross sectional view of the embodiment of FIG. 15.

FIG. 15A depicts a side view of the embodiment shown in FIG. 14. As can be appreciated, the rod shaft 218 extends through the passage 224 toward the rear portion of the locking receptacle. The rod shaft 218 may extend fully through the contact carrier module 204 such that the rod end 226 protrudes from the distal end of the contact carrier module 204 and strain relief portion disposed about the cord. As shown in FIG. 15A, the clamping portion 214 of the spring prong retainer 202 is in the clamping position such that a prong disposed through the aperture 212 of the spring prong retainer 202, upon application of the withdrawn force, would cause the clamping portion 214 to deflect away from perpendicular with respect to a front face 228 of the contact carrier module 204. As such, a clamping force may be imparted on the prong upon application of the withdrawal force.

Figure 15B:
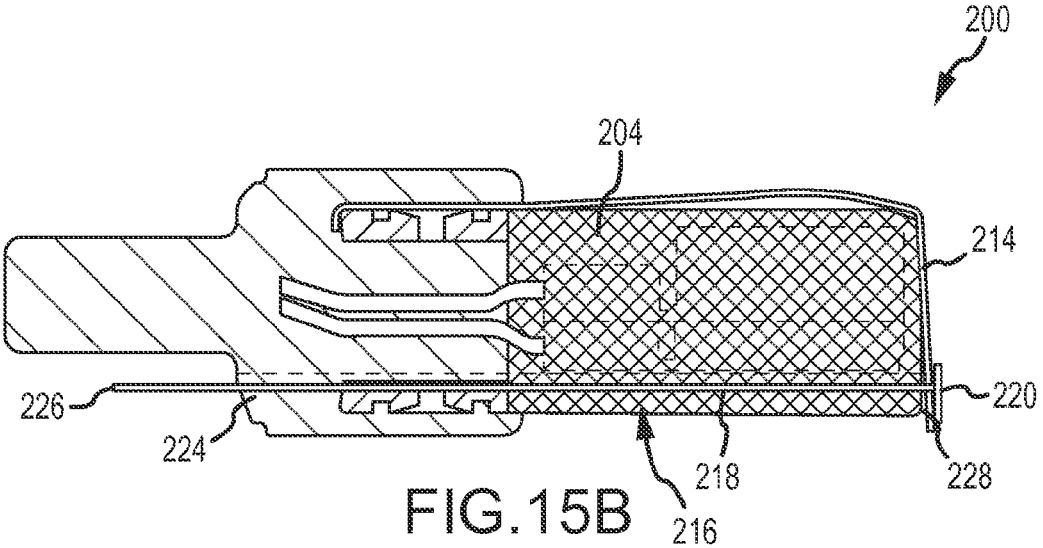

In contrast, FIG. 15B depicts the clamping portion 214 in a release position generally perpendicular to the front face 228 of the contact carrier module 204. The rod 216 be retracted relative to the contact carrier module 204 such that the rod head 220 acts on the clamping portion 214 to urge the clamping portion 214 into the release position as shown.

Figure 16B:
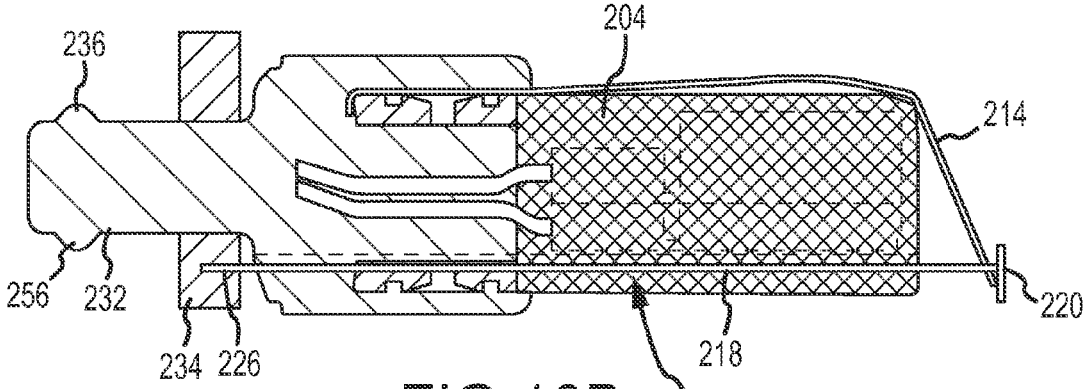

Various embodiments may be provided that function in a similar respect in that a rod end 220 is withdrawn with respect to a deflectable portion 214 of a spring prong retainer 202 to dispose the deflectable portion 214 in the release position. For instance, shown in FIG. 16A, the rod 216 may be fitted with a pull knob 230. The pull knob 230 may be contoured such that a user may grasp of the pull knob 230 in order to retract the direct pull rod 216 with respect the passage 224 and contact carrier module 204 in order to dispose the clamping portion 214 in a release position. Alternatively, as shown in FIG. 16B, the rod 216 may be operatively affixed to a pull collar 234. The pull collar 234 may substantially surround a portion of the strain relief portion 232. The strain relief portion 232 may include a stop 236. As such, the user may grasp the pull collar 234 and withdraw the collar 234 with respect to the strain relief portion 232. In turn, the rod head 220 acts on the clamping portion 214 to dispose in portion 214 in the release position as described above.

Figure 17A:
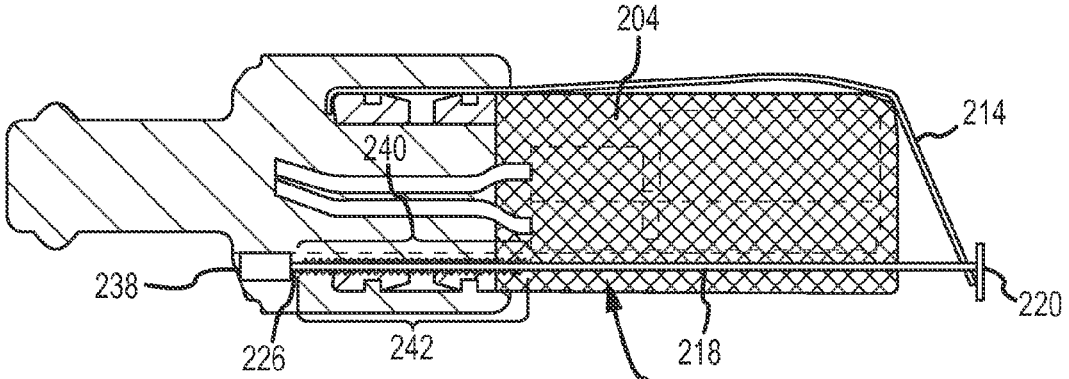
FIGS. 17A-17B illustrate cross sectional views of another embodiment of a release mechanism employing a threaded release mechanism.
Figure 17B:
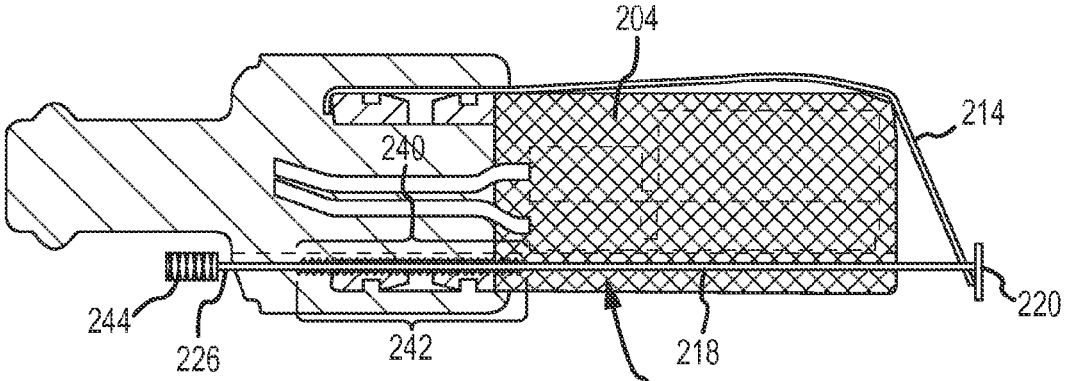

In yet another embodiment depicted in FIG. 17A, the rod shaft 218 may include a threaded rod shaft portion 240 which engages a threaded passage portion 242. The rod 216 may comprise a tooled end 238 (e.g., including a tooled surface corresponding to a Phillips screwdriver, flat head screw driver, hex wrench, Torx™ wrench, etc.). In this regard, the tooled end 238 they be engaged by tool (e.g., a hex wrench, a Torx™ wrench, a screwdriver, or other appropriate tool) such that the rod 216 may be rotated with respect to the passage 224. In this regard, the corresponding threaded rod portion 240 may engage the threaded passage portion 242 to advance or retract the rod 216 with respect to the contact carrier module 204. Alternatively, shown in FIG. 17B. a knurled knob 244 may be provided on the rod 216 such that a user may turn the knurled knob 244 to rotate the rod 216 to engage the threaded rod shaft portion 240 and the threaded passage portion 242 in order to advance or retract the rod 216 with expects to the carrier module 204.

Some embodiments disclosed herein may rely on an internal spring force of the spring prong retainer 202 in order to return the clamping portion 214 thereof to position wherein the clamping portion 214 is in the clamping position. The embodiments depicted in FIGS. 17A and 17B that have a correspondingly threaded rod portion 240 and passage portion 242 may allow the rod 216 to remain in the release position once so disposed. That is, the position of the rod 216 and in turn the clamping portion 214 may be passively maintained in one of the clamping position or the release position. This may be useful in instances where the locking of the locking electrical receptacle 200 function would be advantageously disabled.

Figure 18:
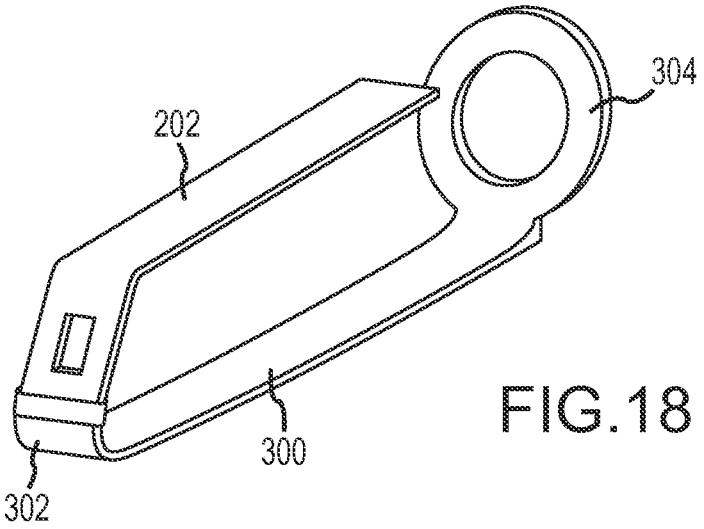
FIG. 18 illustrates another embodiment of a release mechanism.

Another embodiment of a release mechanism for use with a locking receptacle is shown in FIG. 18. A release arm 300 may be provided that includes a contact end 302 and a tactile interface 304 at an opposing end. The contact end 302 may be in contact with the deflectable portion 214 of the spring prong retainer 202. The tactile interface 304 may be disposed adjacent to the rear of the locking receptacle and protrude from the locking receptacle such the user may grasp or otherwise gain purchase on the tactile interface 304 when the receptacle is engaged with a prong. In this regard, the user may be able to withdraw the release arm 300 with respect to the deflectable portion 214 such that the contact end 302 urges the deflectable portion 214 of the spring prong retainer 202 into a release position as described above.

Figure 19A:
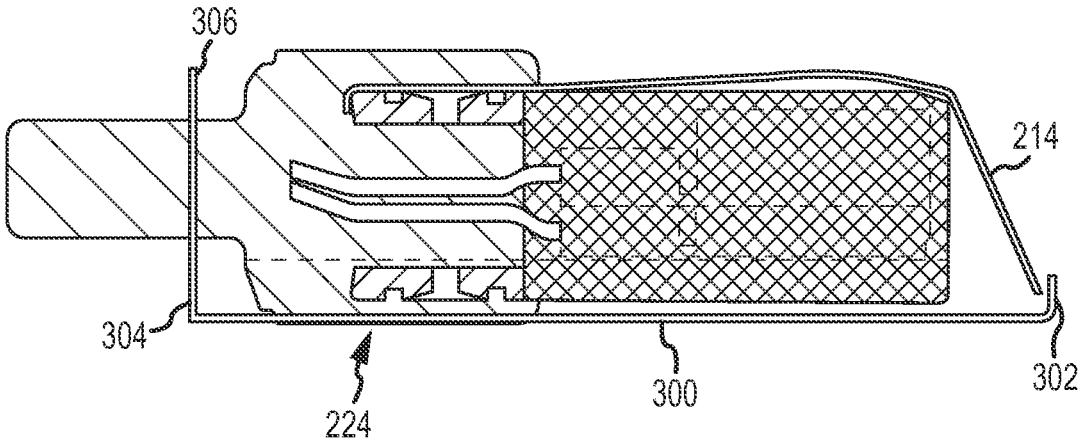
FIGS. 19A-19B illustrate cross sectional views of embodiments of locking electrical receptacles employing the embodiment of FIG. 19.
Figure 19B:
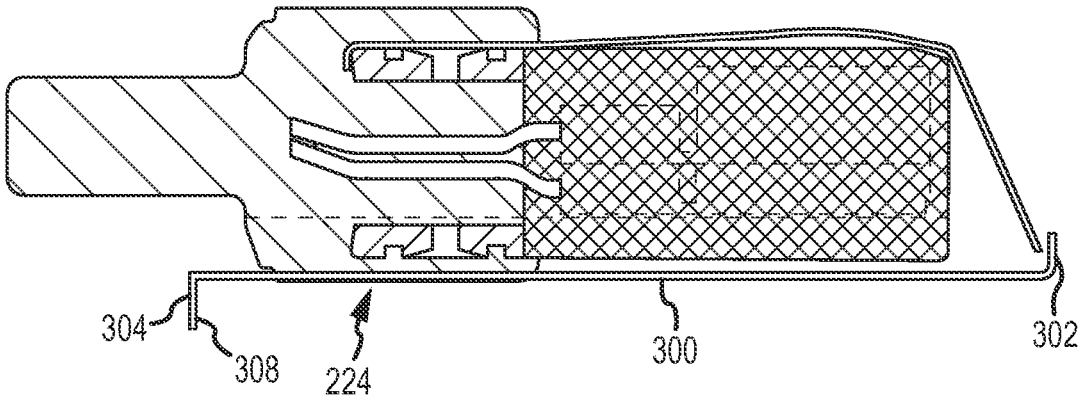

With continued reference to FIGS. 19A and 19B, the release arm 300 may be disposed in a passage 224 defined in the contact carrier and/or strain relief portion such the tactile interface 304 is disposed at the rear of the locking receptacle to be accessed by a user when the receptacle is engaged with a plug. As can be appreciated, the contact end 302, upon the withdrawal of the release arm 300 acts on the deflectable portion 214 of the spring prong retainer 202 to urge the deflectable portion 214 into the release position. The embodiment depicted in FIG. 19A may include a tactile interface that includes a pull ring 306 which is disposed substantially surrounding the over mode portion and cord. FIG. 19B, in contrast, depicts an alternative embodiment where a tab 308 is provided as a tactile interface and is also adapted to be manipulatable by a user to withdraw the release arm.

Figure 20:
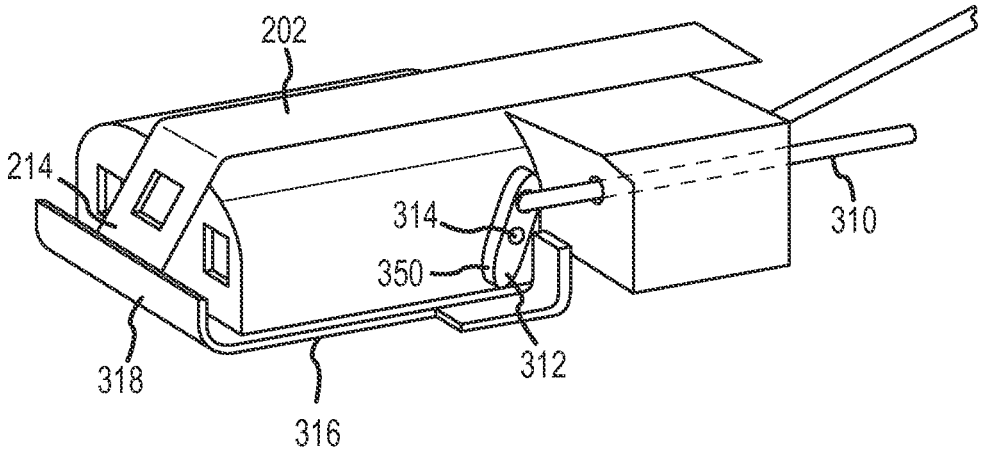
FIG. 20 illustrates another embodiment of locking electrical receptacle including another embodiment of a release mechanism.
Figure 21:
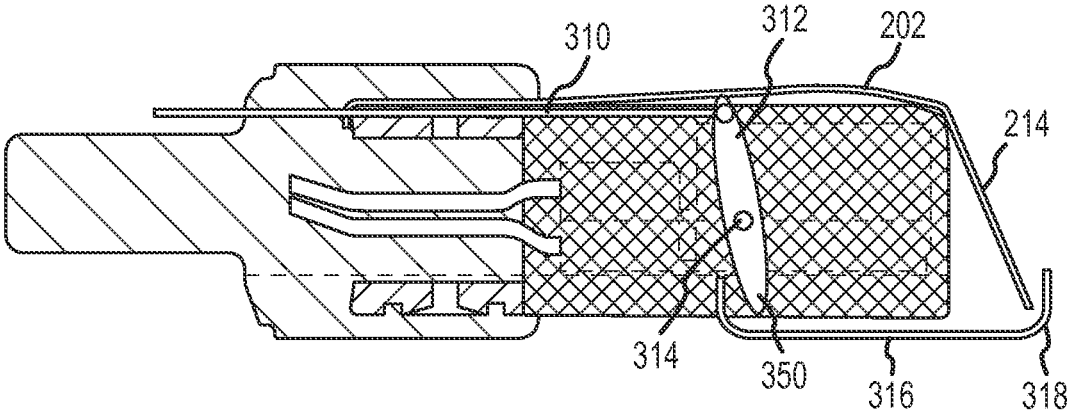
FIG. 21 is a cross sectional view of the embodiment of FIG. 20.

Embodiments discussed above generally include withdrawal of an element away from the interface of the receptacle and plug to directly engage the deflectable portion 214 of the spring prong retainer 202 into release position. In certain embodiments, it may be useful to provide a release mechanism including a user actuation mechanism that is advanced toward the interface of the receptacle and plug rather than retracted from the interface. Depicted in FIGS. 20 and 21 is another embodiment of a release mechanism that employs a pushrod 310 which is advanceable toward the interface of the plug and receptacle in order to release a prong from the receptacle. The pushrod 310 may be in operative communication with a crank 312. The crank 312 may pivot about a pivot 314. Upon advancement of the pushrod 310, the crank 312 may pivot such that the lower portion 350 of the crank 312 is withdrawn with respect to the interface between the receptacle and a plug. The lower portion 350 of the crank 312 may be in contact with a shuttle 316. When the lower portion of the crank 312 is withdrawn, the crank 312 may correspondingly withdraw the shuttle 316. A contact end 318 of the shuttle 316 is withdrawn so as to urge the deflectable portion 214 of the spring prong retainer 202 into release position. In turn, a prong may be released by the locking receptacle upon advancement of the pushrod 310 in a direction toward the interface of the receptacle and plug.

Figure 22:
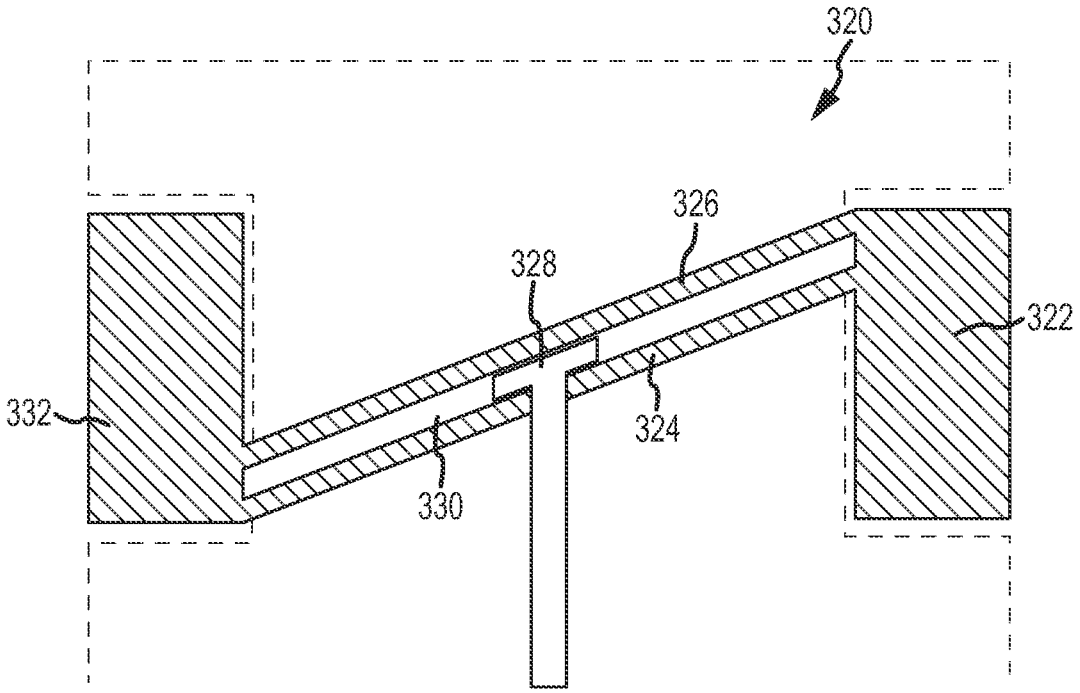
FIG. 22 illustrates an embodiment of a swash plate used in an embodiment of a locking electrical receptacle.

Another embodiment of a mechanism that may be employed for acting on either a push or pull rod as depicted in FIG. 22. This embodiment includes a swash plate 520 which is used to act upon a push or pull rod to dispose the deflectable portion in a release or clamping position according to any of the embodiments described above. The swash plate 320 generally comprise an annular ring 322 disposed about the strain relief portion. The swash plate 320 may include a ramp 324. A rod end may be biased against the ramp 324 by way of the biasing force imposed on the rod by a deflectable portion of a spring prong retainer. Upon rotation of the swash plate 320, the ramp 324 may be advanced or retracted to activate the push or pull rod. A coordinating ramp 326 may be provided that captures and end plate 328 on the rod end. As such, in addition to the biasing force acting to maintain contact between the ramp 324 and the rod, the plate 328 may be captured by a slot 330 defined by the coordinating ramps 324 and 326. As such, upon rotation of the swash plate 320, the rod may be advanced or retracted. As such, embodiments of the swash plate 320 may be used in the foregoing embodiments to urge a deflectable portion of a spring prong retainer into a release position to release a prong. A swash plate such as the one described herein may also be used in conjunction with a release arm wherein the tactile interface is engaged by at least one ramp of a swash plate to advance and/or retract the release arm.

Figure 23:
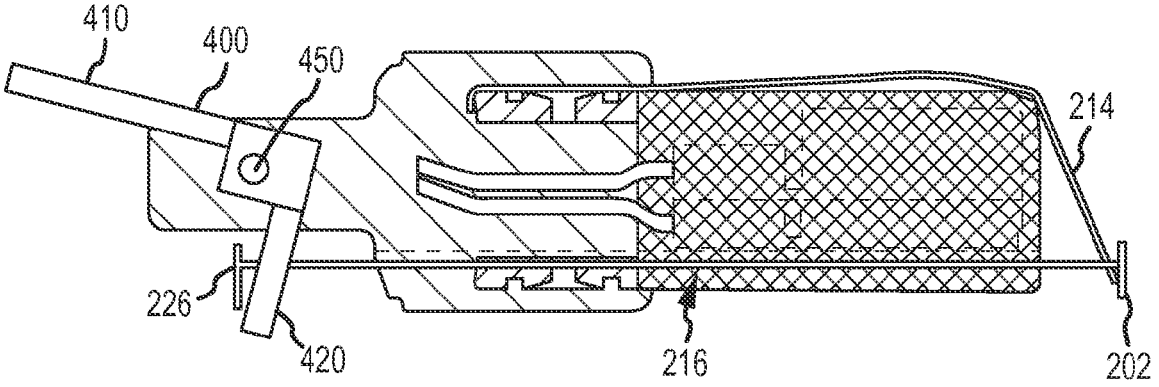
FIG. 23 illustrates a cross sectional view of an embodiment of a locking electrical receptacle with a release mechanism including an actuation lever.

Further still, a lever actuator 400 as shown in FIG. 23 may be provided to engage a rod end 202 to act on a rod 216. In this regard, the lever actuator 400 may move about a pivot 450. The lever actuator 400 may include an engagement portion 420 and an actuation portion 410. Upon movement of the actuation portion 410 by a user may result in the lever actuator 400 rotating about the pivot 450 such that the engagement portion 420 engages the rod end 226. As shown, the actuation portion 410 may engage the rod end 226 to retract the rod 216 relative to the interface between the plug and receptacle. However, a lever actuator 400 could also be provided that facilitates advancement of a release mechanism (e.g., such as the one depicted and described with respect to FIGS. 20 and 21) toward an interface of a plug and receptacle.

The foregoing description of the present invention has been presented for purposes of illustration and description. Furthermore, the description is not intended to limit the invention to the form disclosed herein. Consequently, variations and modifications commensurate with the above teachings, and skill and knowledge of the relevant art, are within the scope of the present invention. The embodiments described hereinabove are further intended to explain best modes known of practicing the invention and to enable others skilled in the art to utilize the invention in such, or other embodiments and with various modifications required by the particular application(s) or use(s) of the present invention. It is intended that the appended claims be construed to include alternative embodiments to the extent permitted by the prior art.

What is claimed is:

1. An apparatus for use in securing an electrical connection, said electrical connection being formed by a mating structure including prongs of a male assembly and receptacles of a female assembly, wherein said electrical connection is broken by withdrawal of said prongs from said receptacles, said apparatus comprising:

a housing having a front surface defining an interface area between said male assembly and female assembly;

a clamping element disposed within said housing and moveable between a clamping configuration and a release configuration, wherein said clamping element holds said mating structure in a connected state in said clamping configuration;

a manual release mechanism, operatively engaged with said clamping element, wherein said release mechanism comprises a manual release member that can be manually operated by a user from an exterior of said housing to move said clamping element to said release configuration; and a strain release member separate from said manual release member and responsive to a withdrawal force acting on said mating structure to urge withdraw of said prong from said receptacle that exceeds a predetermined value to move said mating structure to said release configuration, free from destruction of said housing, and wherein said strain release member resists movement of said mating structure to said release configuration when said withdrawal force is less than said predetermined value.

2. An apparatus according to claim 1, wherein said strain release member comprises a resilient element that responds when said withdrawal force exceeds said predetermined value so as to allow said mating structure to move to said release configuration.

3. An apparatus according to claim 2, wherein said resilient element has an effective spring rate value.

4. An apparatus according to claim 3, wherein said effective spring rate value at least partially determines said predetermined value of said withdrawal force.

5. An apparatus according to claim 3, wherein said resilient element comprises at least one of coordinating inclined planes and steps, coordinating wings and slots, a coil spring, a leaf spring, and a pneumatic spring.

6. An apparatus according to claim 5, wherein said resilient element engages said prong when said mating structure is in the clamping configuration and said withdrawal force is less than said predetermined value.

7. An apparatus according to claim 6, wherein said housing comprises a first housing portion and a second housing portion, wherein when said withdrawal force is greater than said predetermined value, said second housing portion moves with respect to said first housing portion a distance sufficient to engage said clamping element so as to dispose said clamping element in said release configuration.

8. An apparatus according to claim 7, wherein said relative movement comprises axial movement in relation to an axis of one of said prongs.

9. An apparatus according to claim 8, wherein said second housing portion operatively engages said resilient element by way of a rigid member extending from said second housing portion, wherein a first end of said rigid member is fixed with respect to said second housing portion when said second housing portion is moved with respect to said first housing portion such that a second end of said rigid member engages said clamping element.

10. An apparatus according to claim 9, wherein said rigid member comprises a pull rod.

11. An apparatus according to claim 10, wherein said pull rod extends away from said interface and is accessible from an exterior of said housing by a user to dispose said clamping element in said release configuration absent the application of a force acting to withdrawal said prong from said receptacle.

12. A method of use of a locking electrical receptacle device, comprising:

providing a manual release member that can be manually operated by a user from an exterior of a housing of said electrical receptacle device to release mating structure of said locking receptacles, said mating structure including prongs of a male assembly and receptacles of an female assembly;

first applying a withdrawal force to said mating structure less than a predetermined force value;

retaining, in response to said first applying, said mating structure in mating engagement;

second applying a withdrawal force to said mating structure greater than said predetermined force value;

releasing, in response to said second applying and free from manual operation of said manual release member, said mating structure from said mating engagement, said releasing being free from destruction of said housing wherein said releasing comprises:

overcoming a biasing force applied to a first housing portion and a second housing portion of said housing by a resilient element;

displacing said first housing portion; and engaging a clamping element in response to said displacing to dispose said clamping element in said release configuration.

13. The method according to claim 12, wherein said second housing portion is operatively associated with a rigid member extending from said second portion to said clamping member, such that said rigid member is displaceable along with said displacement of said second portion relative to said first portion.

* * * * *